US012601144B2

(12) United States Patent
Fukuda

(10) Patent No.: US 12,601,144 B2
(45) Date of Patent: Apr. 14, 2026

(54) WORKING MACHINE

(71) Applicant: KUBOTA CORPORATION, Osaka (JP)

(72) Inventor: Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 69 days.

(21) Appl. No.: 18/632,491

(22) Filed: Apr. 11, 2024

(65) Prior Publication Data

US 2025/0320691 A1 Oct. 16, 2025

(51) Int. Cl.

| | |
|---|---|
| ***E02F 9/20*** | (2006.01) |
| ***E02F 3/96*** | (2006.01) |
| ***E02F 9/22*** | (2006.01) |

(52) U.S. Cl.

CPC ..... *E02F 9/2025* (2013.01); *E02F 3/96* (2013.01); *E02F 9/2004* (2013.01); *E02F 9/225* (2013.01); *E02F 9/2253* (2013.01); *E02F 9/2203* (2013.01); *E02F 9/2285* (2013.01); *E02F 9/2292* (2013.01); *E02F 9/2296* (2013.01)

(58) Field of Classification Search

CPC ..... E02F 9/2025; E02F 3/96; E02F 9/2004; E02F 9/225; E02F 9/2253; E02F 9/2203; E02F 9/2285; E02F 9/2292; E02F 9/2296

USPC ..... 701/50

See application file for complete search history.

(56) References Cited

U.S. PATENT DOCUMENTS

| | | | | |
|---|---|---|---|---|
| 2014/0076643 | A1* | 3/2014 | Osswald | E02F 3/96 180/9.1 |
| 2021/0198864 | A1* | 7/2021 | Hager | E02F 9/2271 |
| 2023/0415808 | A1* | 12/2023 | Carlson | G05G 5/05 |
| 2025/0137233 | A1 | 5/2025 | Miyabara et al. | |

FOREIGN PATENT DOCUMENTS

| | | | |
|---|---|---|---|
| JP | 2012-207531 | A | 10/2012 |

* cited by examiner

*Primary Examiner* — Mahmoud S Ismail
(74) *Attorney, Agent, or Firm* — Keating & Bennett, LLP

(57) ABSTRACT

A working machine includes a machine body to attach a work attachment thereto, a pair of traveling devices to support opposite side portions of the machine body and to be driven independently of each other, a manual operator to be operated by a user in relation to travel of the machine body, and a controller configured or programmed to perform control relating to the travel of the machine body. The controller is configured or programmed to, while the manual operator is operated in relation to the travel of the machine body, drive the pair of traveling devices independently of each other based on at least one of a state of the machine body or a state of the pair of traveling devices to bring a travel state of the machine body into agreement with an instruction provided by operation of the manual operator.

22 Claims, 18 Drawing Sheets

WORKING MACHINE

BACKGROUND OF THE INVENTION

1. Field of the Invention

The present invention relates to working machines such as skid-steer loaders and compact track loaders.

2. Description of the Related Art

Working machines such as skid-steer loaders and compact track loaders include a machine body, traveling devices to support opposite side portions of the machine body such that the machine body is allowed to travel, and a working device connected to and supported by the machine body, and manual operator(s) to be used to operate the traveling device and the working device (see, for example, Japanese Unexamined Patent Application Publication No. 2012-207531).

Examples of working devices for such working machines include various working devices such as an excavator to excavate soil at a fixed position, a dozer to press and move soil or snow, and a trencher to dig a trench in soil. That is, some working devices are used to perform work at a fixed position, whereas other working devices are used to perform work during travel of the traveling devices.

It is noted here that, when work is performed by a working device to be used to perform work during travel, a load on the working device may act on a position displaced from the center of the traveling working machine, and the working machine may not behave as indicated by the user operation of a manual operator (may make a different travel behavior). That is, although the user operates the manual operator to cause the working machine (working device) to travel in a target direction, the working machine may travel in a direction not intended by the user or the working machine may not be able to travel due to the influence of the load acting on the working device.

SUMMARY OF THE INVENTION

Example embodiments of the present invention provide working machines that each achieve a travel behavior as intended by the user when work is performed during travel.

A working machine according to an example embodiment of the present invention includes a machine body to attach a work attachment thereto, a pair of traveling devices to support opposite side portions of the machine body such that the machine body is allowed to travel, the pair of traveling devices being operable to be driven independently of each other, a manual operator to be operated by a user in relation to travel of the machine body, and a controller configured or programmed to perform control relating to the travel of the machine body, wherein the controller is configured or programmed to, while the manual operator is operated in relation to the travel of the machine body, drive the pair of traveling devices independently of each other based on at least one of a state of the machine body or a state of the pair of traveling devices to bring a travel state of the machine body into agreement with an instruction provided by operation of the manual operator.

In an aspect of an example embodiment of the present invention, the controller may be configured or programmed to, while the manual operator is operated to cause the machine body to travel straight, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

In such a case, the controller may be configured or programmed to, while the manual operator is operated to cause the machine body to travel straight, if traveling loads on the pair of traveling devices differ from each other during the travel of the machine body, determine that the state of the machine body differs from the instruction provided by the operation of the manual operator.

The controller may be configured or programmed to, in a case that the machine body has attached thereto the work attachment including a pair of actuators which are arranged at an interval in a direction perpendicular to a direction of straight travel of the pair of traveling devices and perpendicular to an up-and-down direction and which are operable to independently exert driving forces in a direction of forward travel of the pair of traveling devices, if the manual operator is operated to cause the machine body to travel straight and loads on the pair of actuators during the travel of the machine body differ from each other, determine that the state of the machine body differs from the instruction provided by the operation of the manual operator.

The controller may be configured or programmed to, if the state of the machine body differs from the instruction provided by the operation of the manual operator while the manual operator is operated to cause the machine body to travel straight, drive a first one of the pair of traveling devices that is subjected to a greater traveling load at a drive rotational speed higher than a drive rotational speed of a second one of the pair of traveling devices that is subjected to a smaller traveling load to bring the travel state of the machine body into agreement with the instruction provided by the operation of the manual operator.

The controller may be configured or programmed to determine whether the traveling loads on the pair of traveling devices differ from each other by comparing a preset reference load and the traveling load on at least one of the pair of traveling devices during the travel of the machine body.

The machine body may include a structure to allow attachment thereto and detachment therefrom a work attachment to perform specific work such that the work attachment is replaceable with any of a plurality of types of work attachments to perform different types of work differing from the specific work. The controller may be configured or programmed to extract a reference load for the work attachment attached to the machine body from a plurality of preset reference loads for a plurality of types of work attachments, and determine whether the traveling loads on the pair of traveling devices differ from each other by comparing the extracted reference load and the traveling load on at least one of the pair of traveling devices during the travel of the machine body.

The controller may be configured or programmed to recognize a type of the work attachment attached to the machine body. The plurality of preset reference loads may be set based on respective work characteristics and/or respective work conditions of the plurality of types of work attachments.

The pair of traveling devices may include respective drive motors. The controller may be configured or programmed to recognize loads on the drive motors of the pair of traveling devices during the travel of the machine body as the traveling loads on the pair of traveling devices.

The drive motors may include hydraulic motors. The reference loads may be values of hydraulic pressure. The loads on the drive motors may be values of a pressure of hydraulic fluid supplied to the hydraulic motors.

In such a case, the working machine may further include a hydraulic pump to supply hydraulic fluid to the hydraulic motors. The values of the pressure of hydraulic fluid may be values of a pressure of hydraulic fluid supplied from the hydraulic pump to the hydraulic motors.

The controller may be configured or programmed to enter a low-speed mode in which the controller causes the machine body to travel at a reference speed lower than a predetermined reference speed, and when in the low-speed mode, drive one of the pair of traveling devices that is subjected to the greater load at a drive rotational speed higher than a drive rotational speed corresponding to a travel speed corresponding to the operation of the manual operator and than a drive rotational speed corresponding to a travel speed of the machine body in the low-speed mode.

In another aspect of an example embodiment of the present invention, the controller may be configured or programmed to, in a case that the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

In such a case, the controller may be configured or programmed to, if a traveling load on a first one of the pair of traveling devices is equal to or more than a predetermined value, a drive rotational speed of the first one of the pair of traveling devices is less than a predetermined rotational speed, a traveling load on a second one of the pair of traveling devices is less than the predetermined value, and a drive rotational speed of the second one of the pair of traveling devices is equal to or higher than the predetermined rotational speed, set the drive rotational speed of the second one of the pair of traveling devices to a drive rotational speed lower than the drive rotational speed of the first one of the pair of traveling devices.

The controller may be configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, drive the first one of the pair of traveling devices at a drive rotational speed corresponding to the operation of the manual operator and drive the second one of the pair of traveling devices at a drive rotational speed lower than the drive rotational speed corresponding to the operation of the manual operator.

The controller may be configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, drive each of the pair of traveling devices at a drive rotational speed lower than a drive rotational speed corresponding to the operation of the manual operator.

The working machine may further include a pair of hydraulic motors to drive the respective pair of traveling devices, and a pair of hydraulic pumps to supply hydraulic fluid to the respective pair of hydraulic motors. The controller may be configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, perform control such that a delivery flow rate of hydraulic fluid from a second one of the pair of hydraulic pumps to supply the hydraulic fluid to a second one of the pair of hydraulic motors to drive the second one of the pair of traveling devices is less than a delivery flow rate of hydraulic fluid from a first one of the pair of hydraulic pumps to supply the hydraulic fluid to a first one of the pair of hydraulic motors to drive the first one of the pair of traveling devices.

In such a case, the traveling loads on the pair of traveling devices may be values of a pressure of hydraulic fluid supplied to the pair of hydraulic motors. The values of the pressure of hydraulic fluid may be values of a pressure of hydraulic fluid supplied from the pair of hydraulic pumps to the pair of hydraulic motors.

The controller may be configured or programmed to, while the manual operator is operated to cause the pair of traveling devices to travel straight forward, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
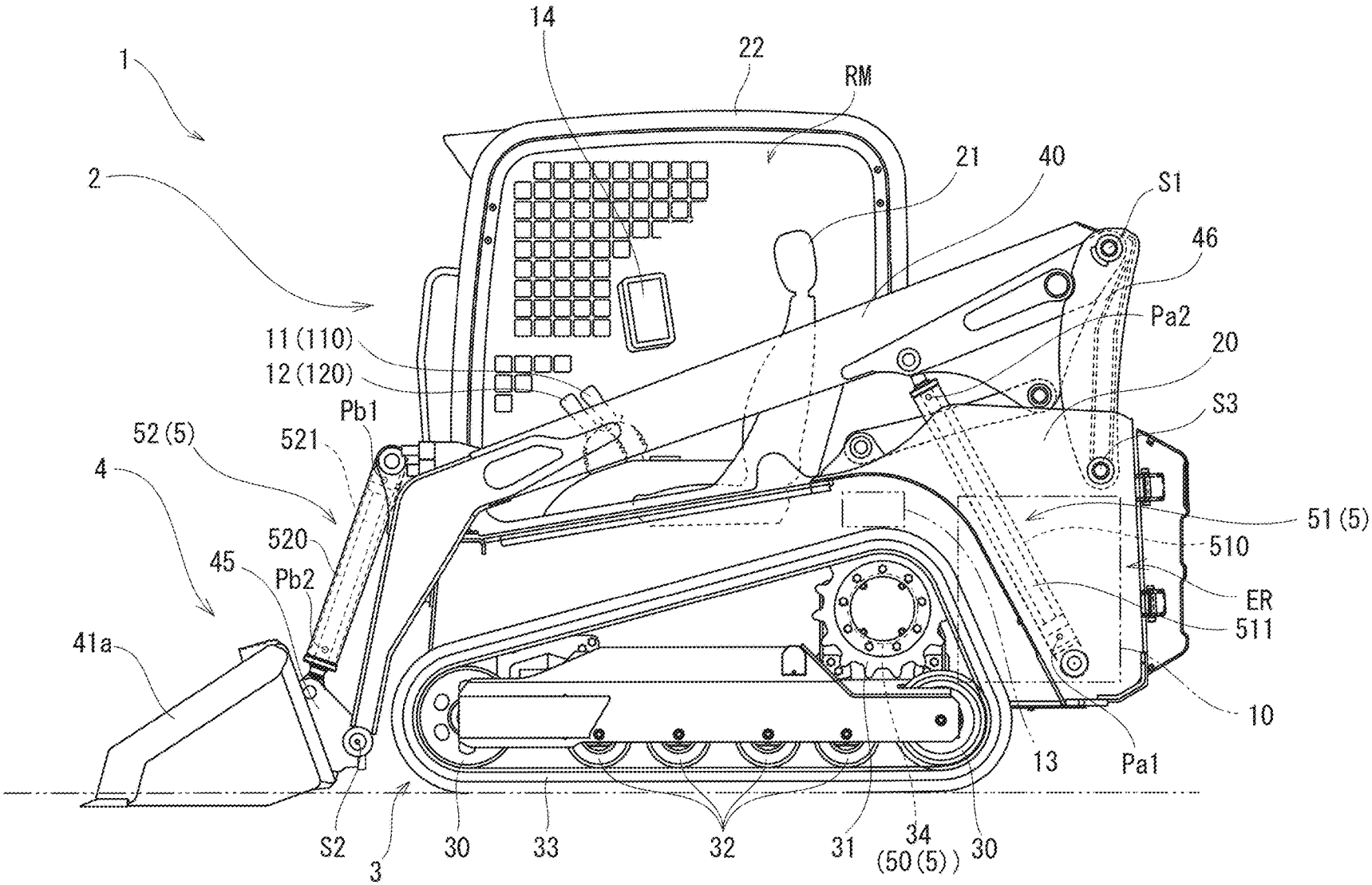
FIG. 1 is a general side view of a working machine according to a first example embodiment of the present invention that has attached thereto a bucket as a work attachment.

Example embodiments will now be described with reference to the accompanying drawings, wherein like reference numerals designate corresponding or identical elements throughout the various drawings. The drawings are to be viewed in an orientation in which the reference numerals are viewed correctly.

The following description discusses example embodiments of the present invention with reference to the drawings as necessary.

As illustrated in FIG. 1, a working machine 1 includes a machine body 2 to attach an attachment 41*a* or the like thereto, and a pair of traveling devices 3 to support left and right side portions of the machine body 2 such that the machine body 2 is allowed to travel. In the present example embodiment, the working machine 1 includes a working device 4 to be connected to the machine body 2 and including a work attachment 41*a*. The working machine 1 also includes hydraulic actuators 50, 51, and 52 to actuate the traveling devices 3 and the working device 4. That is, the working machine 1 includes a hydraulic circuit 5 (hydraulic system) including the hydraulic actuators 50, 51, and 52 to actuate the traveling devices 3 and the working device 4 and hydraulic pump(s) to supply hydraulic fluid to the hydraulic actuators 50, 51, and 52. Accordingly, the working machine 1 includes a prime mover 10 to drive the hydraulic pump. The working machine 1 further includes manual operators 11 and 12 operated by a user in relation to the actuation of the hydraulic actuators 50, 51, and 52 and a controller 13 to control the actuation of the hydraulic actuators 50, 51, and 52. In the present example embodiment, the working machine 1 includes a display 14 to display information relating to work.

The machine body 2 includes a frame chassis 20, a seat 21 provided on the frame chassis 20, and a seat-protecting mechanism 22 to protect the seat 21.

The frame chassis 20 is made of sheet metal, has a three-dimensional shape suitable for the shape and size of the working machine 1, and defines a prime mover chamber ER that contains the prime mover 10 at a rear portion in a front-rear direction.

The seat 21 is located forward of the prime mover chamber ER (prime mover 10) and is fixed to the frame chassis 20. In the present example embodiment, the seat-protecting mechanism 22 is a so-called cabin that surrounds the seat 21. The seat 21 is located forward of the prime mover chamber ER as described above, and therefore the cabin 22 (seat-protecting mechanism 22) is also located forward of the prime mover chamber ER. That is, the cabin 22 defines an operation room RM in which the user who sits on the seat 21 stays at a position forward of the prime mover chamber ER.

The cabin 22 has front, back, left, and right windows, and the manual operators 11 and 12 operated by the user are provided in the cabin 22 (in the operation room RM). The manual operator 11 included in the working machine 1 according to the present example embodiment includes a manual operator (hereinafter referred to as a first manual operator) 11 operated by the user in relation to the travel of the machine body 2. That is, the working machine 1 includes a first manual operator 11 to be operated to control the traveling devices 3. The manual operator 12 included in the working machine 1 includes a manual operator (hereinafter referred to as a second manual operator) 12 operated to control the working device 4. The first manual operator 11 and the second manual operator 12 are provided in the operation room RM such that they can be operated by the user who sits on the seat 21. In the present example embodiment, the first manual operator 11 and the second manual operator 12 are provided at a front portion in the seat 21.

The first manual operator 11 and the second manual operator 12 are respective mechanical lever devices. That is, the first manual operator 11 and the second manual operator 12 include operation levers 110 and 120 pivotable along the front-rear direction and left-right direction. The traveling devices 3 and the working device 4 are actuated based on the degree and direction of pivot of the operation levers 110 and 120. In the following description, the operation lever 110 of the first manual operator 11 is referred to as a first operation lever, and the operation lever 120 of the second manual operator 12 is referred to as a second operation lever.

More specifically, the first manual operator 11 changes the direction of travel of the traveling devices 3 when the direction of pivot of the first operation lever 110 is changed, and controls the travel speed of the traveling devices 3 based on the degree of pivot of the first operation lever 110. The second manual operator 12 changes upward/downward movement of arm(s) 40 of the working device 4 (described later) or the upward/downward pivot (rotation) of the work attachment 41*a* or the like of the working device 4 (described later) when the direction of pivot of the second operation lever 120 is changed, and controls the speed of the upward/downward movement of the arm(s) 40 or the speed of the upward/downward pivot of the work attachment 41*a* or the like based on the degree of pivot of the second operation lever 120. Note that, with regard to the working machine 1 according to the present example embodiment, in the case where the work attachment 41*c* or the like includes a hydraulic cylinder 411*c* (hydraulic actuator to perform its own function) which includes first and second ports Pc1 and Pc2 to be connected to two of AUX ports 65*a*, 65*b*, and 65*c* (described later) to supply and discharge hydraulic fluid and which is configured to extend when supplied with hydraulic fluid through the first port Pc1 and retract when supplied with hydraulic fluid through the second port Pc2 (see FIG. 3), another manual operator (AUX switch 75 in the present example embodiment) that differs from the second operation lever 120 may be operated in relation to the function (actuation of the hydraulic cylinder 411*c*) of the work attachment 41*c*.

The pair of traveling devices 3 support the opposite side portions of the frame chassis 20. In the present example embodiment, the pair of traveling devices 3 are crawler traveling devices. Specifically, each of the pair of traveling devices 3 includes idler(s) 30, driving wheel(s) 31, a plurality of rollers 32, an endless crawler belt 33, and drive motor(s) (hereinafter referred to as traveling motor(s)) 34 to drive the driving wheel(s) 31. The working machine 1 further includes rotation sensors 35L and 35R to measure the drive rotational speeds of the traveling motors 34 (rotational speeds of output shafts of the traveling motors 34) for the pair of traveling devices 33 (see FIGS. 7 and 9). Note that FIG. 1 illustrates a left side surface of the working machine 1, and therefore only one of the traveling devices 3 that supports the left side portion of the frame chassis 20 is illustrated.

A pair of the idlers 30 are provided at an interval in the front-rear direction. The plurality of rollers 32 are provided between the pair of idlers 30. The driving wheel(s) 31 is/are located higher than the rollers 32. The crawler belt 33 is wound around the idlers 30, the driving wheel(s) 31, and the rollers 32.

The traveling motors 34 drive the driving wheels 31 to rotate. In the present example embodiment, each traveling motor 34 is a hydraulic motor. Accordingly, the traveling motor 34 as a hydraulic actuator 50 for travel is connected in the hydraulic circuit 5. The left and right pair of traveling devices 3 rotate and drive the driving wheels 31 to cause the crawler belts 33 to turn.

The working device 4 includes the arm(s) 40 connected to the machine body 2 and a work attachment 41*a* as a function portion directly or indirectly connected to the arm(s) 40.

More specifically, the working device 4 includes the arm(s) 40 which is/are connected to the machine body 2 rotatably about a first shaft S1 extending perpendicularly to the up-and-down direction and which extend(s) to a position forward of the machine body 2, the work attachment 41*a* as a function portion to perform a function corresponding to specific work, and coupler(s) 45 to which the work attachment 41*a* is detachably attached, and the coupler(s) 45 is connected to the distal portion(s) of the arm(s) 40 rotatably about a second shaft S2 extending perpendicularly to the up-and-down direction.

In the present example embodiment, the working machine 1 further includes a plurality of hydraulic actuators 51 and 52 to actuate the working device 4. The plurality of hydraulic actuators 51 and 52 include hydraulic actuators 51 and 52 to switch between a state in which the work attachment (function portion) 41*a* or the like is in contact with a work target object and a state in which the work attachment (function portion) 41*a* or the like is not in contact with the work target object. In the present example embodiment, the hydraulic actuators 51 and 52 to actuate the working device 4 are fluidly connected in the hydraulic circuit 5 and are also mechanically connected in the working device 4.

The arm(s) 40 extends in one direction. Each arm 40 includes a proximal portion directly or indirectly connected to the machine body 2 rotatably about the first shaft S1 and a distal portion at the opposite end of the arm 40 from the proximal portion. The proximal portion and the distal portion are arranged in the one direction. In the present example embodiment, the distal portion of the arm 40 bends downward. The proximal portion of the arm 40 is indirectly connected to the machine body 2. Specifically, the working machine 1 includes link(s) 46 connected to a rear portion of the frame chassis 20 and extending in the up-and-down direction. Each link 46 includes a lower end portion and an upper end portion. The lower end portion of the link 46 is connected to the frame chassis 20 via a lateral shaft S3 extending perpendicularly to the up-and-down direction. On the other hand, a corresponding arm 40 is rotatably connected to the upper end portion of the link 46 via the first shaft S1.

In the present example embodiment, such arms 40 configured as described above are provided on left and right sides of the cabin 22. That is, the working device 4 includes a pair of arms 40 arranged with the cabin 22 therebetween. The shapes and arrangement of the pair of arms 40 are each symmetrical with respect to the widthwise (lateral) center of the cabin 22. Accordingly, a left and right pair of the links 46 are connected to the arms 40. FIG. 1 illustrates the left side surface of the working machine 1, and therefore only the arm 40 and the link 46 provided on the left side are illustrated similarly to the traveling devices 3.

The working device 4 includes, as the hydraulic actuators 51 and 52 to actuate the working device 4, first hydraulic cylinder(s) 51 to rotate the arm(s) 40 about the first shaft S1 to raise/lower the distal portion of the arm(s) 40 and second hydraulic cylinder(s) 52 to rotate the coupler(s) 45 (work attachment 41*a*) about the second shaft S2.

The first hydraulic cylinder(s) 51 and the second hydraulic cylinder(s) 52 include hydraulic cylinders which include hydraulic actuators, and are therefore connected in the hydraulic circuit 5. The first hydraulic cylinder(s) 51 and the second hydraulic cylinder(s) 52 each include a tubular cylinder 510, 520, and a piston rod 511, 521 inserted in the tubular cylinder 510, 520 such that the piston rod is extendable out of and retractable into the tubular cylinder. Each hydraulic cylinder includes a first port Pa1, Pb1 to allow hydraulic fluid to be supplied to the tubular cylinder 510, 520 to move the piston rod 511, 521 in a direction in which the piston rod 511, 521 extends out of the tubular cylinder 510, 520, and a second port Pa2, Pb2 to allow hydraulic fluid to be supplied to the tubular cylinder 510, 520 to move the piston rod 511, 521 in a direction in which the piston rod 511, 521 retracts into the tubular cylinder 510, 520. That is, the first hydraulic cylinder(s) 51 and the second hydraulic cylinder(s) 52 are double-acting hydraulic cylinders.

Such a first hydraulic cylinder 51 is provided for each arm 40. That is, the working device 4 includes a pair of first hydraulic cylinders 51 provided on opposite sides of the cabin 22. The pair of first hydraulic cylinders 51 are symmetrical with respect to the widthwise (lateral) center of the cabin 22 to correspond to the respective pair of arms 40.

Each of the pair of first hydraulic cylinders 51 connects a corresponding arm 40 and the frame chassis 20. That is, the distal end of the piston rod 511 of the first hydraulic cylinder 51 is connected to the arm 40 rotatably about an axis perpendicular to the up-and-down direction, and the end of the tubular cylinder 510 of the first hydraulic cylinder 51 is connected to the frame chassis 20 rotatably about an axis perpendicular to the up-and-down direction.

In the present example embodiment, a pair of the second hydraulic cylinders 52 are provided at an interval in the width direction. The pair of second hydraulic cylinders 52 are symmetrical with respect to the widthwise (lateral) center of the cabin 22. Each of the pair of second hydraulic cylinders 52 connects a corresponding arm 40 and a corresponding coupler 45 to each other. That is, the distal end of the piston rod 521 of the second hydraulic cylinder 52 is connected to the couplers 45 rotatably about an axis perpendicular to the up-and-down direction, and the end of the tubular cylinder 520 of the second hydraulic cylinder 52 is connected to the arm 40 rotatably about an axis perpendicular to the up-and-down direction.

With this, the arm 40 rotates about the first shaft S1 and the distal portion is raised and lowered as the first hydraulic cylinder 51 extends or retracts. The work attachment 41*a* attached to each coupler 45 rotates about the second shaft S2 and swings up or down as the second hydraulic cylinder 52 extends or retracts. Note that, in many cases, a bucket 41*a* is used as the work attachment 41*a* or the like connected to the couplers 45. Since the second hydraulic cylinders 52 cause the bucket 41*a* to swing (rotate), the second hydraulic cylinders 52 are also referred to as bucket cylinders when the couplers 45 are connected to the bucket 41*a*.

Figure 2:
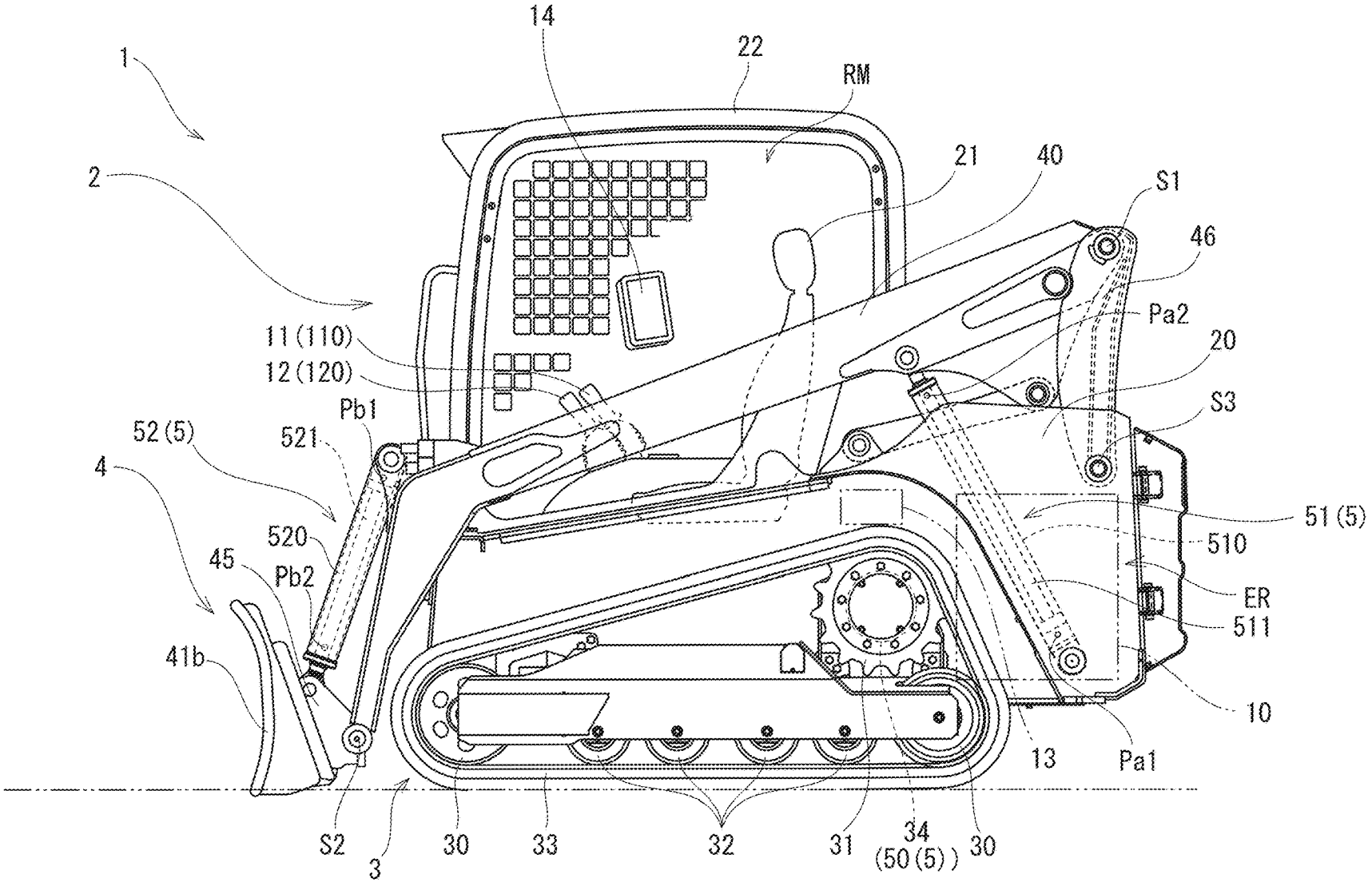
FIG. 2 is a general side view of a working machine according to the first example embodiment of the present invention that has attached thereto a dozer blade as a work attachment.
Figure 3:
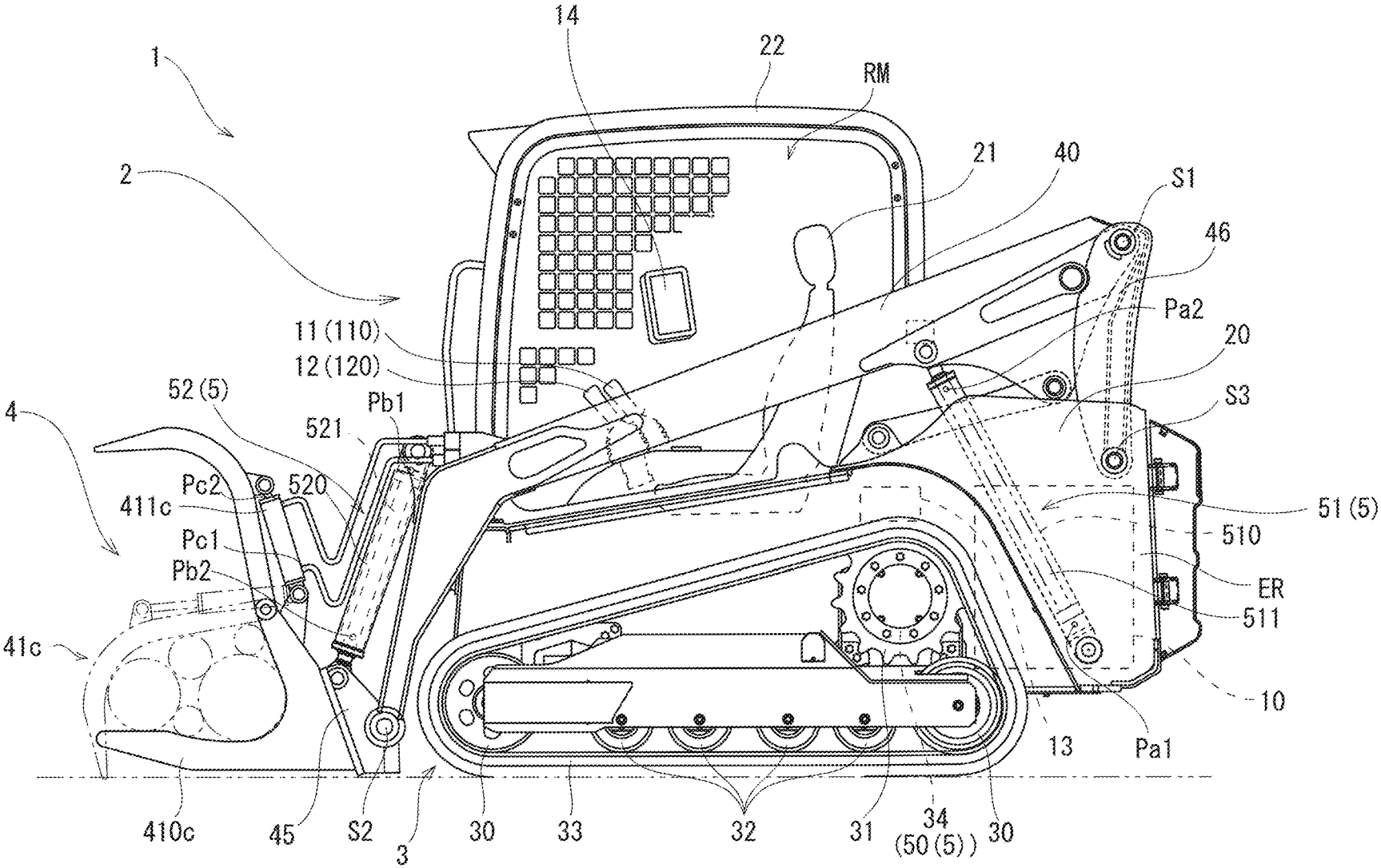
FIG. 3 is a general side view of a working machine according to the first example embodiment of the present invention that has attached thereto a grapple as a work attachment.
Figure 4:
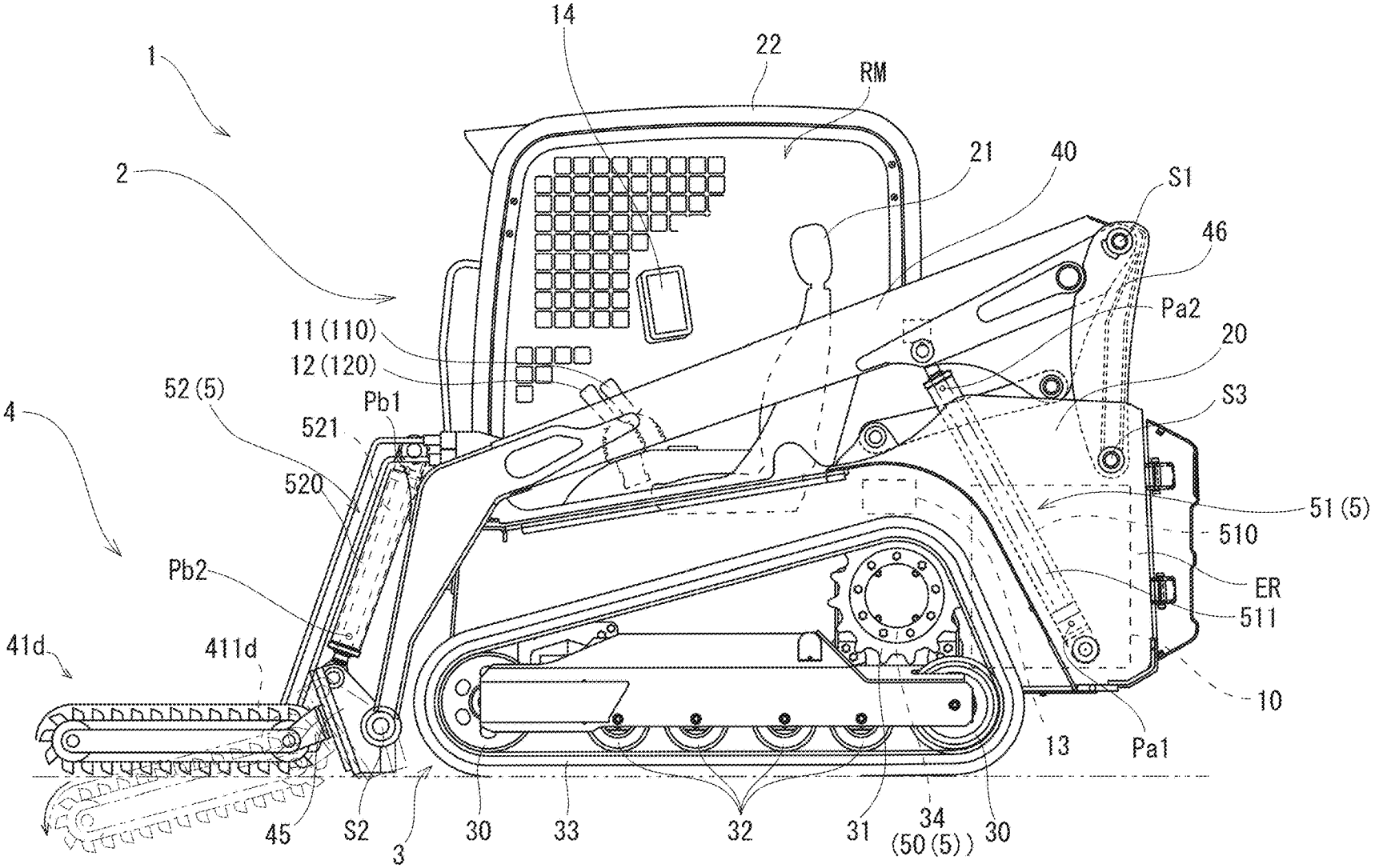
FIG. 4 is a general side view of a working machine according to the first example embodiment of the present invention that has attached thereto a trencher as a work attachment.
Figure 5:
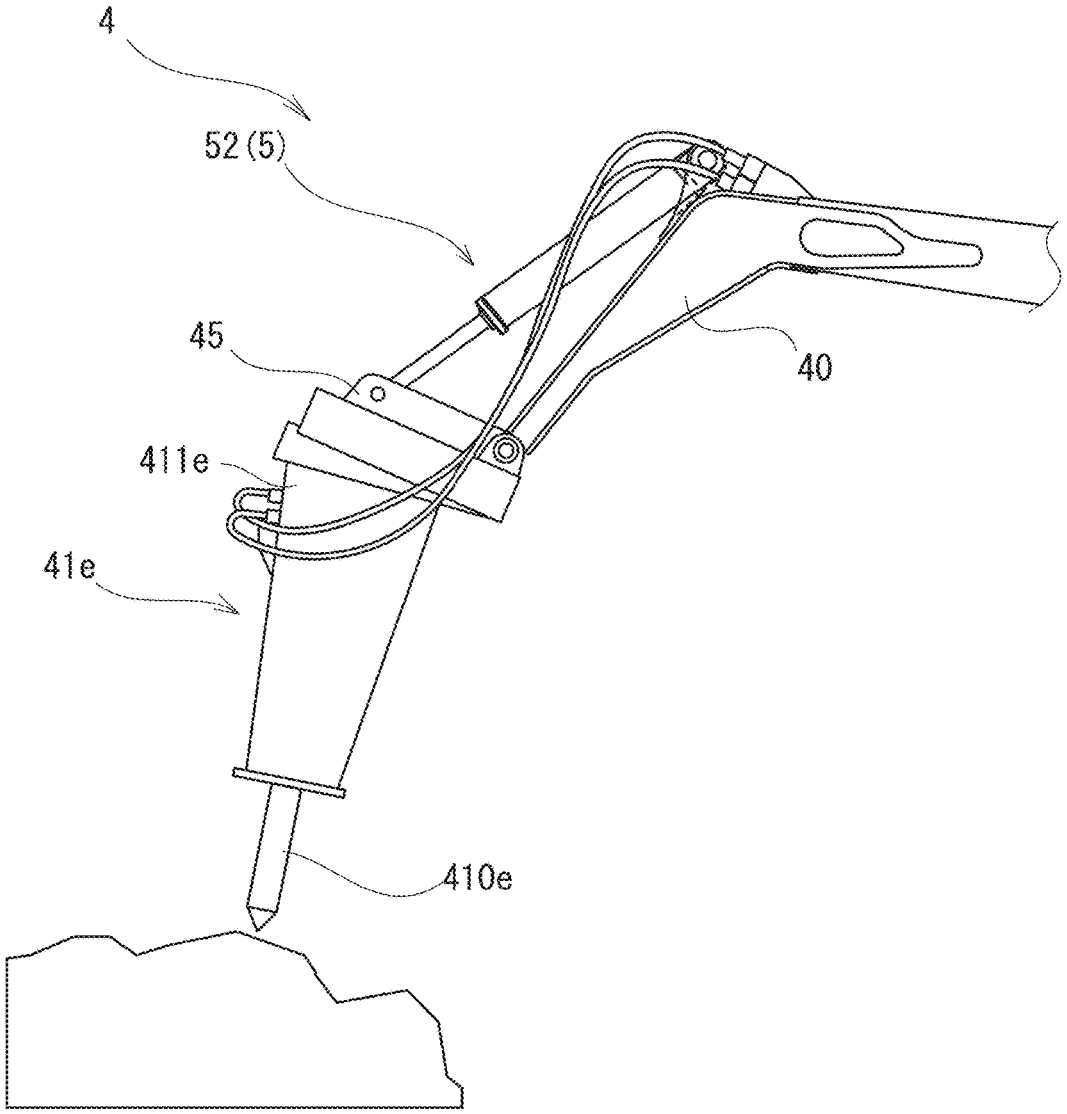
FIG. 5 is a partial side view of a working machine according to the first example embodiment of the present invention that has attached thereto a hydraulic breaker as a work attachment.
Figure 6:
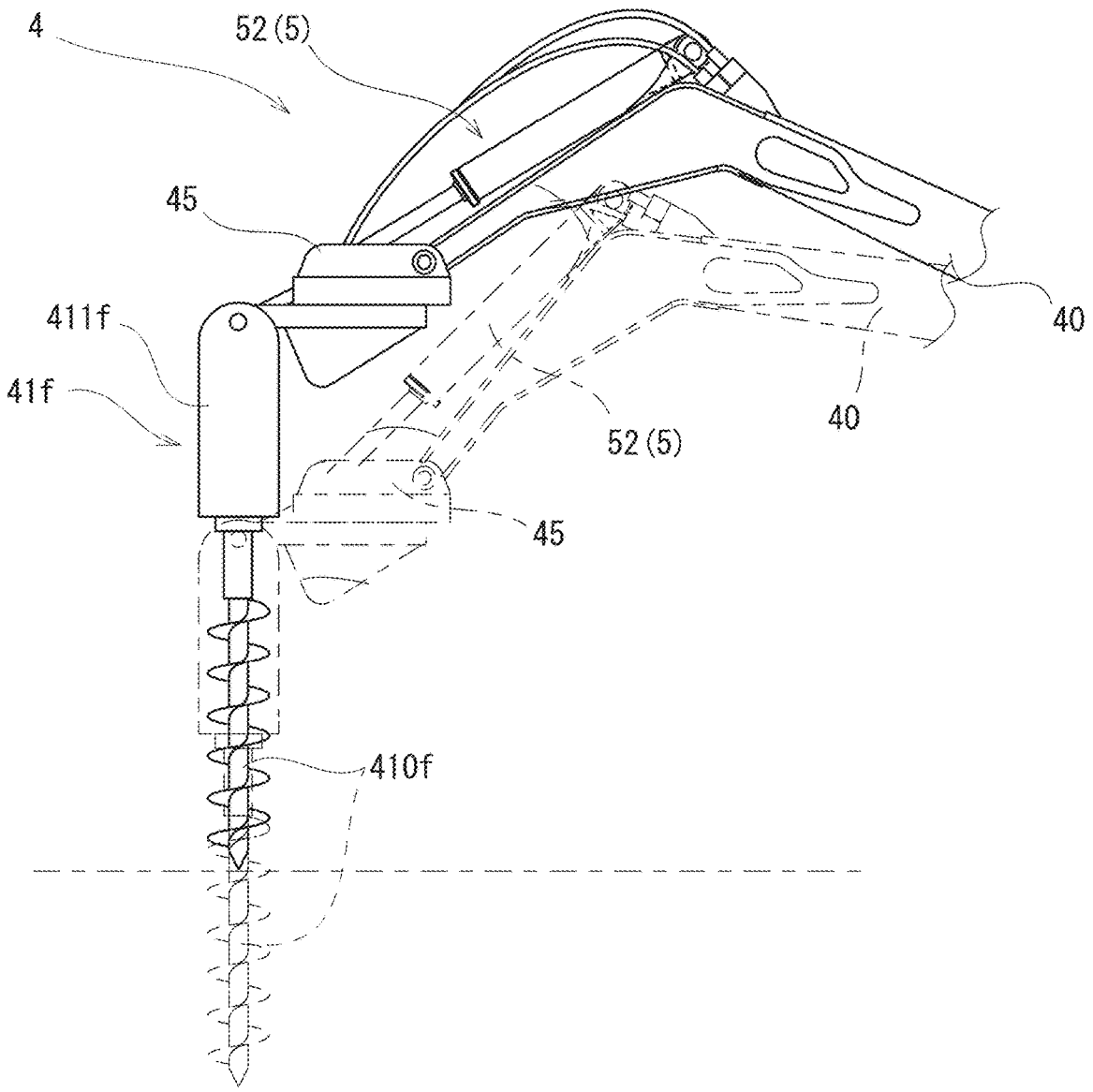
FIG. 6 is a partial side view of a working machine according to the first example embodiment of the present invention that has attached thereto an earth auger as a work attachment.

FIG. 1 illustrates a bucket to excavate soil etc. as the work attachment 41*a*. In addition to the bucket 41*a*, examples of the work attachment also include a dozer blade 41*b* as illustrated in FIG. 2, a grapple 41*c* as illustrated in FIG. 3, and a trencher 41*d* as illustrated in FIG. 4 etc. which are used to perform work during travel (work involving traveling), and a hydraulic breaker 41*e* as illustrated in FIG. 5 and an earth auger 41*f* as illustrated in FIG. 6 etc. which are used to perform work at a fixed position (work performed at a fixed position while the working machine 1 is in a stationary state). Such work attachment 41*a* and the like are attachable and detachable (replaceable) to and from the couplers 45. That is, a work attachment 41*a* is attachable to and detachable from (connectable to and disconnectable from) the machine body 2 via the arm(s) 40 and the coupler(s) 45.

A bucket (see FIG. 1) and a dozer blade (see FIG. 2) which excavate or carry earth and sand etc. are obtained by forming sheet metal into a shape that can be used to perform a function. The grapple 41*c* (see FIG. 3) to hold lumber etc., the trencher 41*d* (see FIG. 4) to dig a trench in soil, the hydraulic breaker 41*e* (see FIG. 5) to break bedrock etc., and the earth auger 41*f* (see FIG. 6) to dig a hole in soil etc. each include hydraulic actuator(s) (a hydraulic motor 411*d*, 411*e*, 411*f*, a hydraulic cylinder 411*c*) to perform a function relating to specific work. Specifically, the trencher 41*d* includes the hydraulic motor 411*d* to rotate a excavator about a predetermined axis to excavate soil, and the hydraulic breaker 41*e* includes the hydraulic motor 411*e* to apply vibrations to a rod-shaped crushing chisel 410*e* which comes into contact with rock etc. The earth auger 41*f* includes a hydraulic motor 411*f* to rotate a digging drill 410*f* to dig a hole in soil. The grapple 41*c* includes the hydraulic cylinder 411*c* to cause a pair of jaws 410*c*, which hold an object therebetween, to approach and move away from each other. Such hydraulic actuators 411*c*, 411*d*, 411*e*, and 411*f* of the work attachments 41*b* and the like are each connected in the hydraulic circuit 5. This will be described together with the hydraulic circuit 5.

Figure 7:
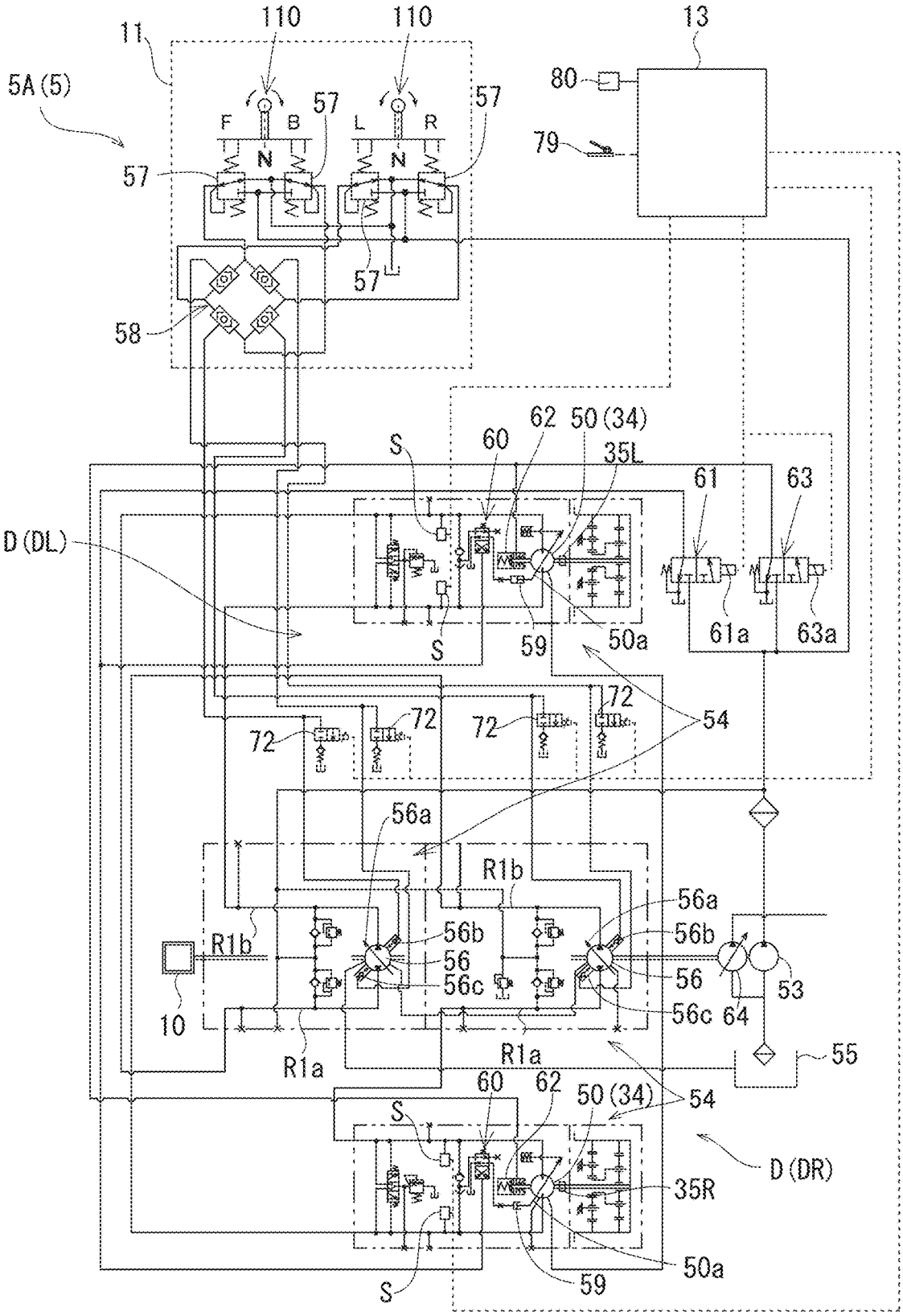
FIG. 7 schematically illustrates a first hydraulic circuit of a hydraulic circuit of a working machine according to the first example embodiment of the present invention.
Figure 8:
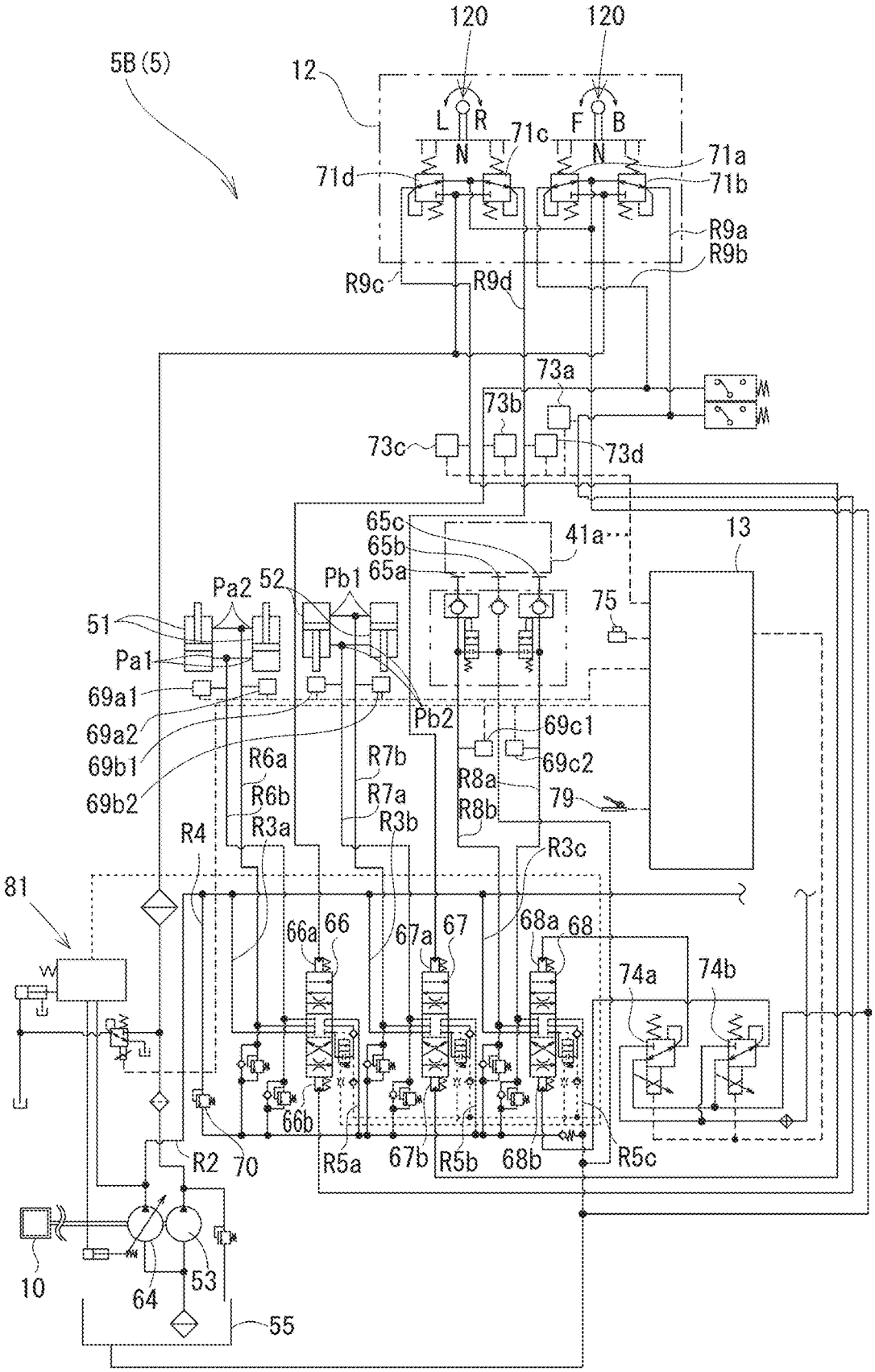
FIG. 8 schematically illustrates a second hydraulic circuit of the hydraulic circuit of the working machine according to the first example embodiment of the present invention.

As illustrated in FIGS. 7 and 8, the hydraulic circuit 5 according to the present example embodiment includes a first hydraulic circuit (hydraulic system for travel) 5A to drive the traveling devices 3 (traveling motor(s) 34 (50)) and a second hydraulic circuit (hydraulic system for work) 5B to drive the working device 4.

The following first discusses the first hydraulic circuit 5A. As illustrated in FIG. 7, the first hydraulic circuit 5A includes a hydraulic pump (hereinafter referred to as a first hydraulic pump) 53 driven by the prime mover 10 to deliver hydraulic fluid and hydrostatic transmission(s) (hereinafter referred to as HST) 54 hydraulically controlled by the pressure of hydraulic fluid delivered by the first hydraulic pump 53 to drive the driving wheel(s) 31 of the traveling device(s) 3. The first hydraulic circuit 5A includes a hydraulic fluid tank 55 to store hydraulic fluid.

The first hydraulic pump 53 is a fixed displacement pump. The first hydraulic pump 53 includes an input shaft. The input shaft of the first hydraulic pump 53 is connected to the output shaft of the prime mover 10. With this, the first hydraulic pump 53 rotates synchronously with the output rotation of the prime mover 10. The first hydraulic pump 53 is driven by the prime mover 10 to suck hydraulic fluid from the hydraulic fluid tank 55 and deliver it toward a downstream portion.

A pair of HSTs 54 are provided for the respective left and right pair of traveling devices 3. Each of the pair of HSTs 54 includes a hydraulic pump (hereinafter referred to as a second hydraulic pump) 56, a traveling motor 34 which is a hydraulic motor 50, and a pair of fluid passages R1*a* and R1*b* provided between the second hydraulic pump 56 and the traveling motor 34. Specifically, the first hydraulic circuit 5A includes a first driver DR to drive one of the pair of traveling devices 3 (right traveling device 3) and a second driver DL to drive the other of the pair of traveling devices 3 (left traveling device 3). The first driver DR and the second driver DL each include a HST 54, a second hydraulic pump 56, a hydraulic motor 50 which is a traveling motor 34, and a pair of fluid passages R1*a* and R1*b*. Note that the first driver DR and the second driver DL have the same structure. Accordingly, in the following description, the first driver DR and the second driver DL are collectively referred to as drivers D. Drivers D indicate the first driver DR and the second driver DL (or a driver D indicates the first driver DR or the second driver DL). That is, the following description can be a description for the first driver DR or the second driver DL by replacing the "driver D" with the "first driver DR" or the "second driver DL", unless otherwise specified.

In the HST 54 of the driver D, the second hydraulic pump 56 includes an input shaft. The input shaft of the second hydraulic pump 56 is connected to the output shaft of the prime mover 10. In the present example embodiment, the output from the prime mover 10 is inputted into the first hydraulic pump 53 and the second hydraulic pump 56. That is, the prime mover 10 is used to drive both the first hydraulic pump 53 and the second hydraulic pump 56. Accordingly, the output shaft of the prime mover 10, the input shaft of the first hydraulic pump 53, and the input shaft of the second hydraulic pump 56 are connected to each other coaxially in a line.

With this, the second hydraulic pump 56 rotates synchronously with the output rotation of the prime mover 10. That is, the first hydraulic pump 53 and the second hydraulic pump 56 each rotate synchronously with the output rotation of the same prime mover 10. A third hydraulic pump 64 of a second hydraulic circuit 5B (described later) also receives the output from the same prime mover 10. The third hydraulic pump 64 includes an output shaft, and therefore the output shaft of the third hydraulic pump 64, the output shaft of the prime mover 10, the input shaft of the first hydraulic pump 53, and the input shaft of the second hydraulic pump 56 are also connected to each other coaxially in a line (in series).

In the HST 54 of the driver D, the second hydraulic pump 56 is a variable displacement pump including a movable swash plate 56*a*. Accordingly, the second hydraulic pump 56 includes a pair of pressure receivers 56*b* and 56*c*. The pair of pressure receivers 56*b* and 56*c* receive pilot hydraulic fluid. With this, the tilt angle and direction of the movable swash plate 56*a* of the second hydraulic pump 56 are controlled.

In the driver D, the second hydraulic pump 56 is driven by the prime mover 10 to suck hydraulic fluid from the hydraulic fluid tank 55 to deliver it toward a downstream portion. In the present example embodiment, the second hydraulic pump 56 delivers hydraulic fluid toward the HST 54 located downstream thereof. With this, hydraulic fluid delivered by the second hydraulic pump 56 is partially introduced into the HST 54.

In the HST 54 of the driver D, the pairs of fluid passages R1*a* and R1*b* that connect the second hydraulic pump 56 and the traveling motor 34 (50) to each other are each provided with a pressure detection sensor S to detect (measure) the pressure of hydraulic fluid supplied from the second hydraulic pump 56 to the traveling motor 34 (50). The pressure detection sensors S are electrically connected to the controller 13 and output the value of the detected pressure of hydraulic fluid, as an electrical signal, to the controller 13 upon each detection.

In the present example embodiment, the first hydraulic pump 53 delivers hydraulic fluid toward the pressure receivers 56*b* and 56*c* of the second hydraulic pump 56 via pump control valve(s) 57 and shuttle valve(s) 58 operably connected to the first operation lever 110. With this, the pressure of hydraulic fluid from the first hydraulic pump 53, as pilot hydraulic fluid to control the movable swash plate 56*a* of the second hydraulic pump 56, acts on the pressure receiver(s) 56*b* and 56*c* of the second hydraulic pump 56. More specifically, in the present example embodiment, the first hydraulic circuit 5A includes pilot fluid passage(s) to connect the pair of pressure receivers 56*b* and 56*c* of the second hydraulic pump 56 and the shuttle valve(s) 58 to each other to supply the pilot hydraulic fluid from the pump control valve(s) 57 operably coupled with the first operation lever 110 via the shuttle valve(s) 58 to the pressure receiver(s) 56*b* and/or 56*c* of the second hydraulic pump 56, and pilot pressure adjustment valve(s) 72 connected at an intermediate position of the pilot fluid passages and to adjust the pressure of pilot hydraulic fluid supplied to the pressure receiver(s) 56*b* and/or 56*c* of the second hydraulic pump 56.

Each pilot pressure adjustment valve 72 is a proportional electromagnetic valve and is electrically connected to the controller 13. That is, the pilot pressure adjustment valve 72 adjusts the pressure of pilot hydraulic fluid supplied from the shuttle valve(s) 58 in accordance with an instruction from the controller 13.

Specifically, the maximum delivery pressure and minimum delivery pressure of the first hydraulic pump 53 are specified. Accordingly, the maximum pressure and minimum pressure of pilot hydraulic fluid correspond to the maximum delivery pressure and minimum delivery pressure of the first hydraulic pump 53. In the present example embodiment, the pressure of pilot hydraulic fluid is normally set to a pressure between the maximum pressure and the minimum pressure (hereinafter referred to as normal set pressure), and the pilot pressure adjustment valve 72 is operable to increase or reduce the pressure based on the normal set pressure. That is, the controller 13 controls the pilot pressure adjustment valve 72 such that the pressure is increased or reduced based on the normal set pressure.

Accordingly, when the first operation lever 110 of the first manual operator 11 is fully pivoted, pilot hydraulic fluid at the normal set pressure flows through the pilot fluid passage (s), and, as the degree of pivot of the first operation lever 110 decreases, pilot hydraulic fluid having a pressure reduced from the normal set pressure is supplied to the second hydraulic pump 56. Accordingly, even when the first operation lever 110 of the first manual operator 11 is fully pivoted, the second hydraulic pump 56 delivers hydraulic fluid at a delivery flow rate that can be further increased.

Accordingly, also the traveling motor 34 (hydraulic motor 50) supplied with hydraulic fluid from the second hydraulic pump 56 is operable to rotate at a drive rotational speed that can be further increased (at a rotational speed that can be further increased) even when the first operation lever 110 of the first manual operator 11 is fully pivoted.

In the present example embodiment, as described earlier, the first operation lever 110 is capable of pivoting along the front-rear and left-right directions, and its neutral position Nis an intermediate position in the left-right direction and an intermediate position in the front-rear direction. In connection with this, in the case where the first operation lever 110 is in the neutral position N, the movable swash plate 56*a* of the second hydraulic pump 56 is in the neutral position, so that the second hydraulic pump 56 does not deliver hydraulic fluid. With this, the traveling motor 34 stays in the stopped state. That is, the pair of traveling devices 3 are in the stopped state, and the working machine 1 (machine body 2) is in the stopped state.

On the other hand, in the case where the first operation lever 110 is pivoted in any of the front-rear and left-right directions, the angle (degree of pivot) and the direction of pivot from the neutral position N determine the angle and direction of tilt of the movable swash plate 56*a* of the second hydraulic pump 56. This determines to drive/stop the traveling motor 34, and determines the direction and the speed of driving/rotating. With this, the direction in which the working machine 1 (machine body 2) travels (turns) and the travel speed are controlled based on the operation (degree of pivot and the direction of pivot) of the first operation lever 110.

In the driver D, the traveling motor 34 (50) is a variable displacement motor including a movable swash plate 50*a*. The movable swash plate 50*a* can be switched between a high-speed tilt state in which the movable swash plate 50*a* is tilted a small angle (small-displacement position) and a low-speed tilt state in which the movable swash plate 50*a* is tilted a large angle (large-displacement position). In the driver D, the traveling motor 34 (50) includes a swash plate control actuator 59 operably connected to the movable swash plate 50*a*. A switching valve 60 is fluidly connected to the swash plate control actuator 59 of the traveling motor 34.

The switching valve 60 can be switched between a hydraulic fluid supply state in which hydraulic fluid is supplied to the swash plate control actuator 59 and a hydraulic fluid discharge state in which hydraulic fluid is discharged from the swash plate control actuator 59. Accordingly, the manner in which the movable swash plate 50*a* of the traveling motor 34 (50) is tilted is changed according to a change in the state of the switching valve 60.

The switching valve 60, upon receipt of the pressure (hydraulic pressure) of pilot hydraulic fluid, enters the hydraulic fluid supply state. The switching valve 60, upon release from pilot hydraulic fluid, returns to the hydraulic fluid discharge state. Hydraulic fluid from the first hydraulic pump 53, as pilot hydraulic fluid to the switching valve 60, is supplied to the switching valve 60 via an electromagnetic switching valve 61 for speed change.

The electromagnetic switching valve 61 for speed change can be switched between an open state in which hydraulic fluid is allowed to flow through a flow passage and a closed state in which hydraulic fluid is blocked from flowing through the flow passage. The electromagnetic switching valve 61 for speed change includes a solenoid 61*a* and a spring and is normally biased by the spring in the closed state. In the closed state, the electromagnetic switching valve 61 for speed change blocks hydraulic fluid from flowing from the first hydraulic pump 53 to the switching valve 60 and brings the switching valve 60 into the hydraulic fluid discharge state.

The solenoid 61*a* of the electromagnetic switching valve 61 for speed change is electrically connected to the controller 13. With this, the electromagnetic switching valve 61 for speed change, upon receipt of a control signal from the controller 13, enters the open state by energization of the solenoid 61*a*, allowing hydraulic fluid from the first hydraulic pump 53 to be discharged as pilot hydraulic fluid to the switching valve 60. With this, the switching valve 60 enters the hydraulic fluid supply state.

The working machine 1 includes a transmission switch 80 electrically connected to the controller 13 to switch between a high-speed mode in which the traveling devices 3 travel at high speed and a low-speed mode in which the traveling devices 3 travel at low speed. Note that the low-speed mode indicates a mode in which the machine body 2 (working machine 1) travels at a lower speed than in the high-speed mode, and the machine body 2 (working machine 1) travels at a low reference speed lower than a predetermined reference speed.

When the transmission switch 80 is operated to select the high-speed mode, the controller 13 causes the electromagnetic switching valve 61 for speed change to enter the closed state, so that the switching valve 60 enters the hydraulic fluid discharge state. Accordingly, the movable swash plate 50*a* of the traveling motor 34 enters the high-speed tilt state, and the traveling motor 34 (50) rotates at high speed. On the contrary, when the transmission switch 80 is operated to select the low-speed mode, the controller 13 causes the electromagnetic switching valve 61 for speed change to enter the open state, so that the switching valve 60 enters the hydraulic fluid supply state. Accordingly, the movable swash plate 50*a* of the traveling motor 34 (50) enters the low-speed tilt state, and the traveling motor 34 (50) rotates at low speed.

In the present example embodiment, the traveling motor 34 (50) is provided with a braking actuator 62 which is a hydraulic actuator. The braking actuator 62, upon receipt of hydraulic fluid, brakes the traveling motor 34 (50). Hydraulic fluid from the first hydraulic pump 53 is supplied to the braking actuator 62 of the traveling motor 34 via an electromagnetic switching valve 63 for braking.

The electromagnetic switching valve 63 for braking can be switched between an open state in which hydraulic fluid is allowed to flow through a flow passage and a closed state in which hydraulic fluid is blocked from flowing through the flow passage. The electromagnetic switching valve 63 for braking includes a solenoid 63*a* and a spring and is normally biased by the spring in the closed state. In the closed state, the electromagnetic switching valve 63 for braking blocks hydraulic fluid from the first hydraulic pump 53 from flowing toward the braking actuator 62 of the traveling motor 34 (50).

The solenoid 63*a* of the electromagnetic switching valve 63 for braking is electrically connected to the controller 13. The electromagnetic switching valve 63 for braking, upon receipt of a control signal from the controller 13, enters the open state by energization of the solenoid 63*a*, allowing hydraulic fluid from the first hydraulic pump 53 to be supplied to the braking actuator 62. With this, the traveling motor 34 (50) is braked.

The working machine 1 includes a brake pedal 79 electrically connected to the controller 13 to switch between braking and not braking the traveling motor 34 (50). When the brake pedal 79 is not depressed by the user, the controller 13 keeps the electromagnetic switching valve 63 for braking in the closed state. Therefore, the traveling motor 34 (50) is not braked. On the other hand, when the brake pedal is depressed by the user, the controller 13 brings the electromagnetic switching valve 63 for braking into the open state. With this, the traveling motor 34 (50) is braked.

The second hydraulic circuit 5B (system) will now be described. As illustrated in FIG. 8, the second hydraulic circuit 5B includes the third hydraulic pump 64 which is driven by the prime mover 10 to deliver hydraulic fluid and which supplies hydraulic fluid to the hydraulic actuators 51 and 52 (first hydraulic cylinder(s) 51, the second hydraulic cylinder(s) 52, and/or the hydraulic actuator 411*c* or the like of the work attachment 41*c* or the like) of the working device 4. The second hydraulic circuit 5B includes the hydraulic fluid tank 55 to store hydraulic fluid. The hydraulic fluid tank 55 is shared by the first hydraulic circuit 5A and the second hydraulic circuit 5B. In the present example embodiment, the second hydraulic circuit 5B includes a pump controller (so-called load sensing system (LS system)) 81 to control the delivery flow rate of the third hydraulic pump 64 depending on work.

The third hydraulic pump 64 is a variable displacement pump capable of changing the delivery flow rate. The third hydraulic pump 64 includes an input shaft. The input shaft of the third hydraulic pump 64 is connected to the output shaft of the prime mover 10.

In the present example embodiment, the input shaft of the third hydraulic pump 64 is connected coaxially in a line (in series) with the input shaft of the first hydraulic pump 53 and the input shafts of the second hydraulic pumps 56 of the first hydraulic circuit 5A (see FIGS. 7 and 8). That is, in the hydraulic circuit 5 according to the present example embodiment, hydraulic pumps (first hydraulic pump 53, second hydraulic pumps 56, third hydraulic pump 64) are driven by the same prime mover 10. With this, the third hydraulic pump 64 rotates synchronously with the output rotation of the prime mover 10. The third hydraulic pump 64 is driven by the prime mover 10 to suck hydraulic fluid from the hydraulic fluid tank 55 and deliver it toward a downstream position.

The second hydraulic circuit 5B includes a plurality of AUX ports 65*a*, 65*b*, and 65*c* to which pipes leading to the hydraulic actuator 411*c*, 411*d* or the like of the work attachment 41*c*, 41*d* or the like are connected detachably. The second hydraulic circuit 5B includes a control valve (hereinafter referred to as a first control valve) 66 to control the flow of hydraulic fluid supplied to the first hydraulic cylinders 51 and a control valve (hereinafter referred to as a second control valve) 67 to control the flow of hydraulic fluid supplied to the second hydraulic cylinders 52, as well as a control valve (hereinafter referred to as a third control valve) 68 to control the flow of hydraulic fluid supplied to and discharged from the hydraulic actuator of the work attachment 41*c* or the like via two of the plurality of AUX ports 65*a*, 65*b*, and 65*c*. The second hydraulic circuit 5B includes pressure detectors 69*a*1, 69*a*2, 69*b*1, 69*b*2, 69*c*1, and 69*c*2 electrically connected to the controller 13 to detect the pressure of hydraulic fluid in the hydraulic actuators 51, 52, 411*c*, 411*d* and/or the like (first hydraulic cylinders 51, the second hydraulic cylinders 52, and/or the hydraulic actuator 411*c*, 411*d* or the like of the work attachment 41*c*, 41*d* or the like) attached to the working device 4.

The second hydraulic circuit 5B includes a pipe (hereinafter referred to as a delivery fluid passage) R2 connected to the delivery port of the third hydraulic pump 64 and a plurality of pipes (hereinafter referred to as supply fluid passages) R3*a*, R3*b*, and R3*c* branching from the delivery fluid passage R2 in parallel and connected to the pump ports of the first control valve 66, the second control valve 67, and the third control valve 68, respectively. The second hydraulic circuit 5B also includes a pipe (hereinafter referred to as a bleed-off fluid passage) R4 which branches from the delivery fluid passage R2 at a position located upstream of the positions at which the plurality of supply fluid passages R3*a*, R3*b*, and R3*c* branch to reach the hydraulic fluid tank 55 and which is provided with a flow rate adjustment valve 70 at an intermediate position thereof, and pipes (hereinafter referred to as drain fluid passages) R5*a*, R5*b*, and R5*c* connected downstream of the tank ports of the first control valve 66, the second control valve 67, and the third control valve 68 and the flow rate adjustment valve 70 of the bleed-off fluid passage R4. With this, the flow rate of hydraulic fluid in the delivery fluid passage R2 is adjusted by the flow rate adjustment valve 70 of the bleed-off fluid passage R4.

In the present example embodiment, the working device 4 includes the first hydraulic cylinders 51 and the second hydraulic cylinders 52 as the hydraulic actuators 51 and 52. When the work attachment 41*c*, 41*d* or the like including the hydraulic actuator 411*d*, 411*d* or the like is attached to the working device 4, the working device 4 includes, as hydraulic actuators thereof, not only the first hydraulic cylinders 51 and the second hydraulic cylinders 52 but also the hydraulic actuator 411*c*, 411*d* or the like of the work attachment 41*c*, 41*d* or the like.

Accordingly, the second hydraulic circuit 5B includes, as the pressure detectors 69*a*1, 69*a*2, 69*b*1, 69*b*2, 69*c*1, and 69*c*2, first pressure detectors 69*a*1 and 69*a*2 electrically connected to the controller 13 to detect the pressure of hydraulic fluid in the first hydraulic cylinders 51, second pressure detectors 69*b*1 and 69*b*2 electrically connected to the controller 13 to detect the pressure of hydraulic fluid in the second hydraulic cylinders 52, and third pressure detectors 69*c*1 and 69*c*2 electrically connected to the controller 13 to detect the pressure of hydraulic fluid in the hydraulic actuator of the work attachment 41*b* or the like.

As described earlier, the first hydraulic cylinders 51 and the second hydraulic cylinders 52 are each a double-acting hydraulic cylinder and include the first port Pa1, Pb1 and the second port Pa2, Pb2 via which hydraulic fluid enters and exits. Accordingly, the first pressure detectors 69*a*1 and 69*a*2 are connected to a pair of supply-discharge passages (hereinafter referred to as first supply-discharge passages) R6*a* and R6*b* which are pipes connected to the first ports Pa1 and the second ports Pa2 of the first hydraulic cylinders 51, and the second pressure detectors 69*b*1 and 69*b*2 are connected to a pair of supply-discharge passages (hereinafter referred to as second supply-discharge passages) R7*a* and R7*b* which are pipes connected to the first ports Pb1 and the second ports Pb2 of the second hydraulic cylinders 52. The third pressure detectors 69*c*1 and 69*c*2 are connected to a pair of supply-discharge passages (hereinafter referred to as third supply-discharge passages) R8*a* and R8*b* which are pipes to connect the third control valve 68 and two AUX ports 65*a* and 65*c* (hydraulic fluid ports) to each other.

In the present example embodiment, the pair of first pressure detectors 69*a*1 and 69*a*2 are provided near the first ports Pa1 and the second ports Pa2 of the first hydraulic cylinders 51 in the pair of first supply-discharge passages R6*a* and R6*b*. The pair of second pressure detectors 69*b*1 and 69*b*2 are provided near the first ports Pb1 and the second ports Pb2 of the second hydraulic cylinders 52 in the pair of second supply-discharge passages R7*a* and R7*b*. The pair of third pressure detectors 69*c*1 and 69*c*2 are provided near the AUX ports 65*a* and 65*c* in the pair of third supply-discharge passages R8*a* and R8*b*.

With this, the pair of first pressure detectors 69*al* and 69*a*2 detect the pressure of hydraulic fluid at the first port Pa1 of each first hydraulic cylinder 51 and the pressure at the second port Pa2 of the first hydraulic cylinder 51, and the pair of second pressure detectors 69*b*1 and 69*b*2 detect the pressure of hydraulic fluid at the first port Pb1 of each second hydraulic cylinder 52 and at the second port Pb2 of the second hydraulic cylinder 52. On the contrary, the pair of third pressure detectors 69*c*1 and 69*c*2 detect the pressure of hydraulic fluid supplied to and discharged from the hydraulic actuator 411*c*, 411*d* or the like of the work attachment 41*c*, 41*d* or the like via the pair of AUX ports 65*a* and 65*c*.

The pressure detectors 69*a*1, 69*a*2, 69*b*1, 69*b*2, 69*c*1, and 69*c*2 (first pressure detectors 69*a*1 and 69*a*2, second pressure detectors 69*b*1 and 69*b*2, third pressure detectors 69*c*1 and 69*c*2), upon detecting the pressure of hydraulic fluid, output the detection result as a signal to the controller 13.

The control valves 66, 67, and 68 (first control valve 66, second control valve 67, third control valve 68) are pilot-pressure-controlled direction switching valves each including a spool with pressure receivers 66*a*, 66*b*, 67*a*, 67*b*, 68*a*, and/or 68*b* to receive pilot pressure at opposite sides thereof. The first hydraulic pump 53 of the first hydraulic circuit 5A is configured to supply hydraulic fluid for control (pilot hydraulic fluid) also to the control valves (first control valve 66, second control valve 67, third control valve 68) of the second hydraulic circuit 5B. That is, the first hydraulic pump 53 is used by both the first hydraulic circuit 5A and the second hydraulic circuit 5B and supplies hydraulic fluid for control (pilot hydraulic fluid) to target positions in the entire hydraulic circuit 5.

In the present example embodiment, the second hydraulic circuit 5B includes operation valves 71*a*, 71*b*, 71*c*, and 71*d* to actuate the first hydraulic cylinders 51 and the second hydraulic cylinders 52 based on the operation of the second operation lever 120. In the present example embodiment, the second operation lever 120 is pivotable about the lower end thereof. Based on this, the plurality of operation valves 71*a*, 71*b*, 71*c*, and 71*d* are provided around the lower portion of the second operation lever 120. Specifically, the second operation lever 120 is pivotable along the front-rear and left-right directions about the lower end thereof. Accordingly, a pair of (two of) the operation valves 71*a*, 71*b*, 71*c*, and 71*d* are provided forward and rearward of the second operation lever 120, and the other pair of (other two of) the operation valves 71*a*, 71*b*, 71*c*, and 71*d* are provided leftward and rightward of the second operation lever 120. Among the plurality of (four) operation valves 71*a*, 71*b*, 71*c*, and 71*d*, one or more of the operation valves 71*a*, 71*b*, 71*c*, and 71*d* at position(s) corresponding to the direction of pivot of the second operation lever 120 is/are actuated. That is, when the second operation lever 120 is pivoted in forward, rearward, leftward, or rightward, one or more of the operation valves 71*a*, 71*b*, 71*c*, and 71*d* at position(s) corresponding to the direction of pivot of the second operation lever 120 is/are actuated, so that hydraulic fluid from the first hydraulic pump 53 as pilot hydraulic fluid is discharged from the one or more of the operation valves 71*a*, 71*b*, 71*c*, and 71*d* corresponding to the pivot of the second operation lever 120 toward the control valve(s) (first control valve 66, second control valve 67).

Specifically, the neutral position N of the second operation lever 120 is an intermediate position in the front-rear direction and an intermediate position in the left-right direction, similarly to the first operation lever 110. When the second operation lever 120 is pivoted in the forward direction F from the neutral position N, the corresponding operation valve 71*a* allows pilot hydraulic fluid (hydraulic fluid) in an amount corresponding to the pivot angle (operation amount) of the second operation lever 120 to flow. Accordingly, pilot hydraulic fluid (hydraulic fluid) is supplied to one pressure receiver 66*a* of the first control valve 66 via a pilot fluid passage, and the spool of the first control valve 66 moves in one direction. With this, hydraulic fluid is supplied from the first control valve 66 to the second ports Pa2 of the first hydraulic cylinders 51 via the supply-discharge passage R6*a*, and hydraulic fluid is discharged into the first control valve 66 via the supply-discharge passage R6*b* from the first ports Pa1 of the first hydraulic cylinders 51. With this, the first hydraulic cylinders 51 retract, and the arms 40 are lowered.

In contrast, when the second operation lever 120 is pivoted in the rearward direction B from the neutral position N, the corresponding operation valve 71*b* allows pilot hydraulic fluid (hydraulic fluid) in an amount corresponding to the pivot angle (operation amount) of the second operation lever 120 to flow. Accordingly, pilot hydraulic fluid (hydraulic fluid) is supplied to the opposite pressure receiver 66*b* of the first control valve 66 via a pilot fluid passage, and the spool of the first control valve 66 moves in the opposite direction. With this, hydraulic fluid is supplied from the first control valve 66 to the first ports Pa1 of the first hydraulic cylinders 51 via the supply-discharge passage R6*b*, and hydraulic fluid is discharged into the first control valve 66 via the supply-discharge passage R6*a* from the second ports Pa2 of the first hydraulic cylinders 51. With this, the first hydraulic cylinders 51 extend, and the arms 40 are raised.

Furthermore, when the second operation lever 120 is pivoted in the rightward direction R from the neutral position N, the corresponding operation valve 71*d* allows pilot hydraulic fluid (hydraulic fluid) in an amount corresponding to the pivot angle (operation amount) of the second operation lever 120 to flow. Accordingly, pilot hydraulic fluid (hydraulic fluid) is supplied to the pressure receiver 67*a* of the second control valve 67 via a pilot fluid passage R9*d*, and the spool of the second control valve 67 moves in one direction. With this, hydraulic fluid is supplied from the second control valve 67 to the first ports Pb1 of the second hydraulic cylinders 52 via the supply-discharge passage R7*b*, and hydraulic fluid is discharged into the second control valve 67 via the supply-discharge passage R7*a* from the second ports Pb2 of the second hydraulic cylinders 52. With this, the second hydraulic cylinders 52 extend, and the work attachment 41*a* or the like rotates downward with respect to the arms 40 (counterclockwise in the drawing). That is, in the case where the work attachment 41*a* or the like is a bucket, the bucket is brought into a dumping posture (discharging posture) in which the bucket discharges earth and sand etc.

On the contrary, when the second operation lever 120 is pivoted in the leftward direction L from the neutral position N, the corresponding operation valve 71*c* allows pilot hydraulic fluid (hydraulic fluid) in an amount corresponding to the pivot angle (operation amount) of the second operation lever 120 to flow. Accordingly, pilot hydraulic fluid (hydraulic fluid) is supplied to the pressure receiver 67*b* of the second control valve 67 via a pilot fluid passage R9*c*, and the spool of the second control valve 67 moves in the opposite direction. With this, hydraulic fluid is supplied from the second control valve 67 to the second ports Pb2 of the second hydraulic cylinders 52 via the supply-discharge passage R7*a*, and hydraulic fluid is discharged into the second control valve 67 via the supply-discharge passage R7*b* from the first ports Pb1 of the second hydraulic cylinders 52. With this, the second hydraulic cylinders 52 retract, and the work attachment 41*a* or the like rotates upward with respect to the arms 40 (clockwise direction in the drawing). That is, in the case where the work attachment 41*a* or the like is a bucket, the bucket is brought into a shoveling posture in which the bucket scoops earth and sand etc.

In the present example embodiment, the second hydraulic circuit 5B includes a plurality of pilot pressure detectors 73*a*, 73*b*, 73*c*, and 73*d* electrically connected to the controller 13 to detect the hydraulic pressure in the pilot fluid passages R9*a*, R9*b*, R9*c*, and R9*d* connected to the plurality of operation valves 71*a*, 71*b*, 71*c*, and 71*d*. The plurality of pilot pressure detectors 73*a*, 73*b*, 73*c*, and 73*d* input signals indicating the detection result (values of the hydraulic pressure in the pilot fluid passages R9*a*, R9*b*, R9*c*, and R9*d*) into the controller 13.

Accordingly, the controller 13 determines whether the first control valve 66 or the second control valve 67 is actuated (first hydraulic cylinder(s) 51 or the second hydraulic cylinder(s) 52 are extending or retracting) based on the signals inputted from the plurality of pilot pressure detectors 73*a*, 73*b*, 73*c*, and 73*d*. That is, the controller 13 determines whether the second operation lever 120 is operated to actuate the arm(s) 40 or the second hydraulic cylinder(s) 52 (whether the second operation lever 120 is pivoted from the neutral position N). The controller 13 recognizes the state (position) of the first control valve 66 or the second control valve 67, i.e., the direction and extent (operation amount) of pivot of the second operation lever 120 (angle and direction of pivot from the neutral position), based on the signals from the plurality of pilot pressure detectors 73*a*, 73*b*, 73*c*, and 73*d*.

The second hydraulic circuit 5B includes a pair of solenoid valves 74*a* and 74*b* to control the third control valve 68. Accordingly, the working machine 1 includes the AUX switch 75 electrically connected to the controller 13 that changes the states of the solenoid valves 74*a* and 74*b*.

The solenoid valves 74*a* and 74*b* are supplied with, as hydraulic fluid functioning as pilot hydraulic fluid for the third control valve 68, hydraulic fluid from the third hydraulic pump 64 via, for example, a delivery fluid passage. Note that, in FIG. 8, the source of pilot hydraulic fluid (hydraulic fluid) to the solenoid valves 74*a* and 74*b* is not illustrated.

The AUX switch 75 may be any of various switches such as a seesaw switch, a slide switch, or a push switch. The AUX switch 75, when operated by the user, inputs an electrical signal corresponding to the operation into the controller 13, as a signal. The controller 13, upon receiving the signal based on the operation of the AUX switch 75, outputs electric current corresponding to the signal as a control signal to one of the solenoid valves (solenoids) 74*a* and 74*b*. That is, the AUX switch 75 determines which of the solenoid valves 74*a* and 74*b* to actuate, in response to the user operations.

When the AUX switch 75 is operated to actuate the solenoid valve 74*a*, and the solenoid of the solenoid valve 74*a* receives a control signal from the controller 13 and is energized. Accordingly, pilot hydraulic fluid (hydraulic fluid) is supplied from the solenoid valve 74*a* to the pressure receiver 68*a* of the third control valve 68. With this, the state of the third control valve 68 is changed, hydraulic fluid is supplied from the third control valve 68 to the hydraulic actuator of the work attachment 41*c* or the like via the AUX port 65*a* which is one of the two AUX ports 65*a* and 65*c*, whereas hydraulic fluid from the hydraulic actuator of the work attachment 41*b* or the like is returned to the third control valve 68 via the AUX port 65*c*.

On the contrary, when the AUX switch 75 is operated to actuate the solenoid valve 74*b*, the solenoid of the solenoid valve 74*b* receives a control signal from the controller 13 and is energized. Accordingly, pilot hydraulic fluid (hydraulic fluid) is supplied from the solenoid valve 74*b* to the pressure receiver 68*b* of the third control valve 68. With this, the state of the third control valve 68 is changed, hydraulic fluid is supplied from the third control valve 68 to the hydraulic actuator of the work attachment 41*b* or the like via the AUX port 65*c* of the two AUX ports 65*a* and 65*c*, whereas hydraulic fluid from the hydraulic actuator 411*c*, 411*d* or the like of the work attachment 41*c* or the like is returned to the third control valve 68 via the AUX port 65*a*. With this, the direction of supply (flow) of hydraulic fluid to the hydraulic actuator 411*c*, 411*d* or the like of the work attachment 41*c* or the like is changed, and the actuation of the work attachment 41*c* is changed.

Figure 9:
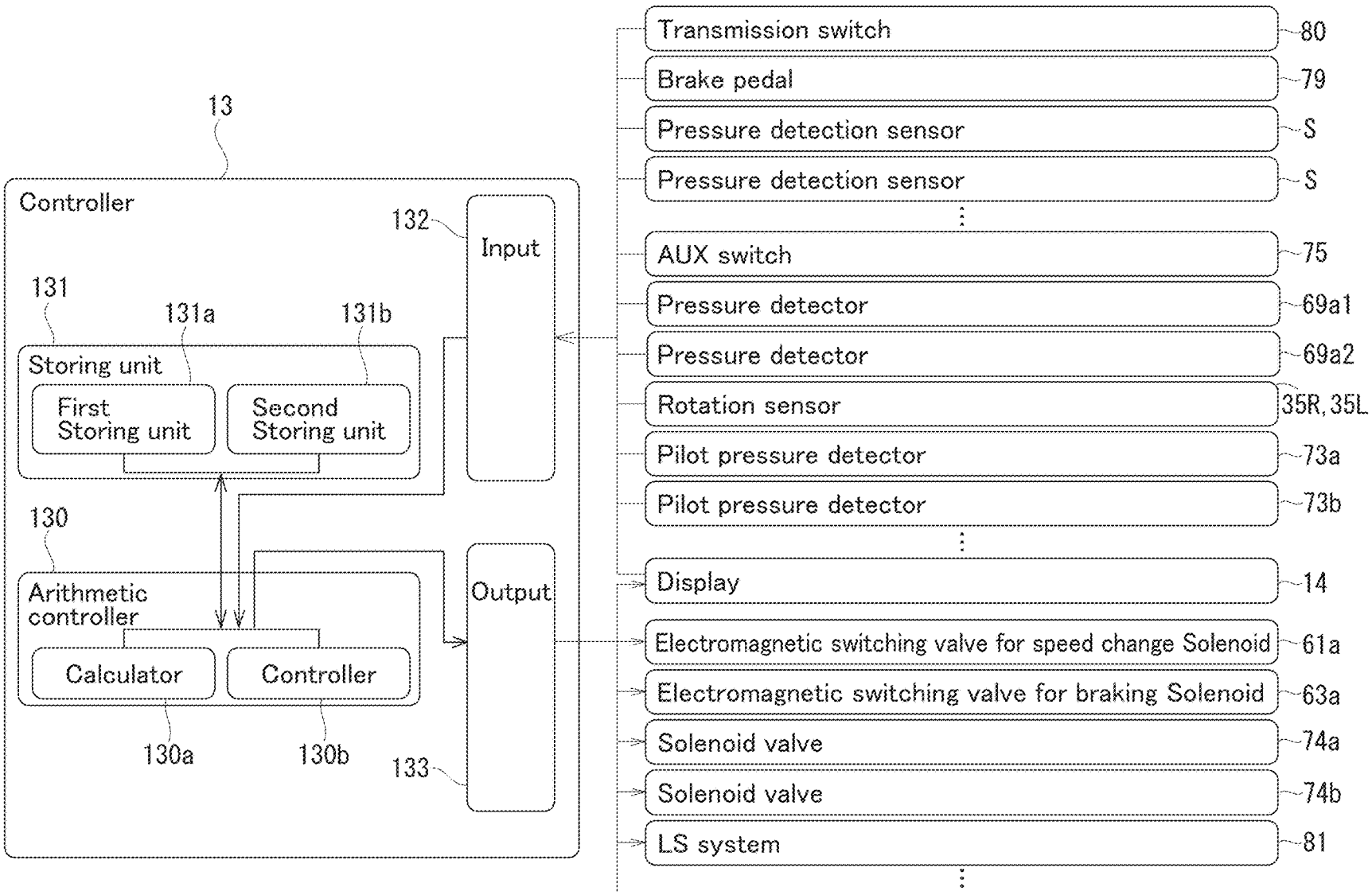
FIG. 9 schematically illustrates a block diagram of an electrical system of a working machine according to the first example embodiment of the present invention.

As illustrated in FIG. 9, the controller 13 is a so-called ECU and includes an arithmetic controller 130, a storing unit 131 (storage and/or memory) to store information used for processing by the arithmetic controller 130, an input 132 electrically connected to the arithmetic controller 130 to input an electrical signal as input information from external electrical device(s) into the arithmetic controller 130, and an output 133 electrically connected to the arithmetic controller 130 to output an instruction signal (electrical signal) as output information from the arithmetic controller 130 to external electrical device(s).

The arithmetic controller 130 is a CPU (MPU) and includes a calculator 130*a* and a controller 130*b*. In the controller 13 according to the present example embodiment, the storing unit 131 includes a first storing unit 131*a* to store information for use in processing performed by the arithmetic controller 130 (calculator 130*a* and controller 130*b*) temporarily or in the short term and a second storing unit 131*b* to store information for use in processing performed by the arithmetic controller 130 (calculator 130*a* and controller 130*b*) in the long-term. The first storing unit 131*a* may be a so-called memory. The second storing unit 131*b* may be a storage such as a hard disk or a solid state drive (SSD).

The input 132 and the output 133 are so-called interfaces. Electrical device(s) to output an electrical signal as information is connected to the input 132. On the contrary, electrical device(s) to receive an electrical signal as information is connected to the output 133.

Specifically, as devices relating to the first hydraulic circuit 5A, the transmission switch 80, the brake pedal 79, and the pressure detection sensor(s) S etc. are connected to the input 132, and, as devices relating to the second hydraulic circuit 5B, the AUX switch 75, the pressure detectors 69*a*1 and 69*a*2 etc., the pilot pressure detectors 73*a*, 73*b*, 73*c*, and 73*d*, the rotation sensors 35L and 35R, and a posture detector etc. are connected to the input 132. On the other hand, as devices relating to the first hydraulic circuit 5A, the electromagnetic switching valve 61 for speed change (solenoid 61*a*) and the electromagnetic switching valve 63 for braking (solenoid 63*a*) etc. are connected to the output 133, and, as devices relating to the second hydraulic circuit 5B, the LS system 81, and the solenoid valves 74*a* and 74*b* etc. are connected to the output 133.

In the present example embodiment, the display 14 is a touchscreen monitor. Accordingly, the display 14 is connected to the input 132 and the output 133 in order to transmit and receive information to and from the controller 13 (arithmetic controller 130).

As described earlier, there are various types of work attachments 41*a* and the like, and those which are used to perform work during travel differ in terms of traveling loads on the traveling devices 3 when work is performed during travel. Accordingly, a reference based on which to determine whether the travel state of the traveling devices 3 while the work attachment 41*a* or the like is performing work during travel is appropriate or not is set as a reference load. That is, the storing unit 131 stores, as the reference load, a load that would be imposed on the traveling devices 3 which travel in a normal manner when the work attachment 41*a* or the like is performing work during the travel.

Figure 10:
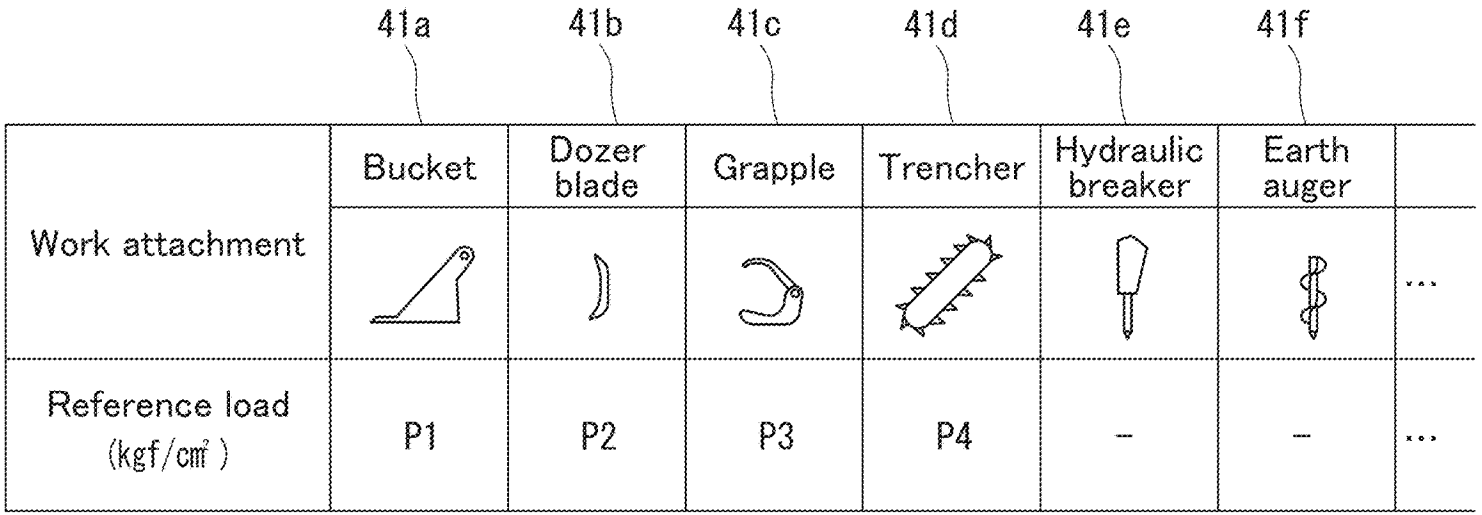
FIG. 10 is a conceptual diagram of an attachment list stored in a storing unit of a working machine according to the first example embodiment of the present invention.

In the present example embodiment, the reference loads P1, P2 and the like are set for those of the work attachments 41*a* and the like that are used to perform work during travel, as illustrated in FIG. 10. That is, the reference loads are set based on work characteristics and/or work conditions of the plurality of types of work attachments 41*a* and the like. Accordingly, the storing unit 131 (second storing unit 131*b*) stores the model (type) of the work attachment 41*a* or the like and the reference load P1 or P2 etc. corresponding to the model (type) such that they are associated with each other. Note that the reference load P1, P2 or the like is a load that would be imposed on the traveling devices 3 which travel in a normal manner when the work attachment 41*a* or the like performs work during the travel, and is obtained by actual measurement in the present example embodiment. In the present example embodiment, each traveling motor 34 (50) is a hydraulic motor, and therefore the set reference load (traveling load as a reference) P1 or P2 etc. is the pressure (hydraulic pressure) of hydraulic fluid supplied from the second hydraulic pumps 56 of the HSTs 54 to the traveling motors 34 which include hydraulic motors 50.

In the present example embodiment, the storing unit 131 (second storing unit 131*b*) stores an attachment list including the model(s) (model name(s)) of the work attachment(s) 41*a* and the like associated with pictogram(s) (icon(s)) representing the work attachment(s) 41*a* and the like. With this, the storing unit 131 (second storing unit) stores an attachment list in which the pictogram(s) (icon(s)) representing the work attachment(s) 41*a* and the like are also associated with the reference load(s) P1, P2 and the like.

Figure 11:
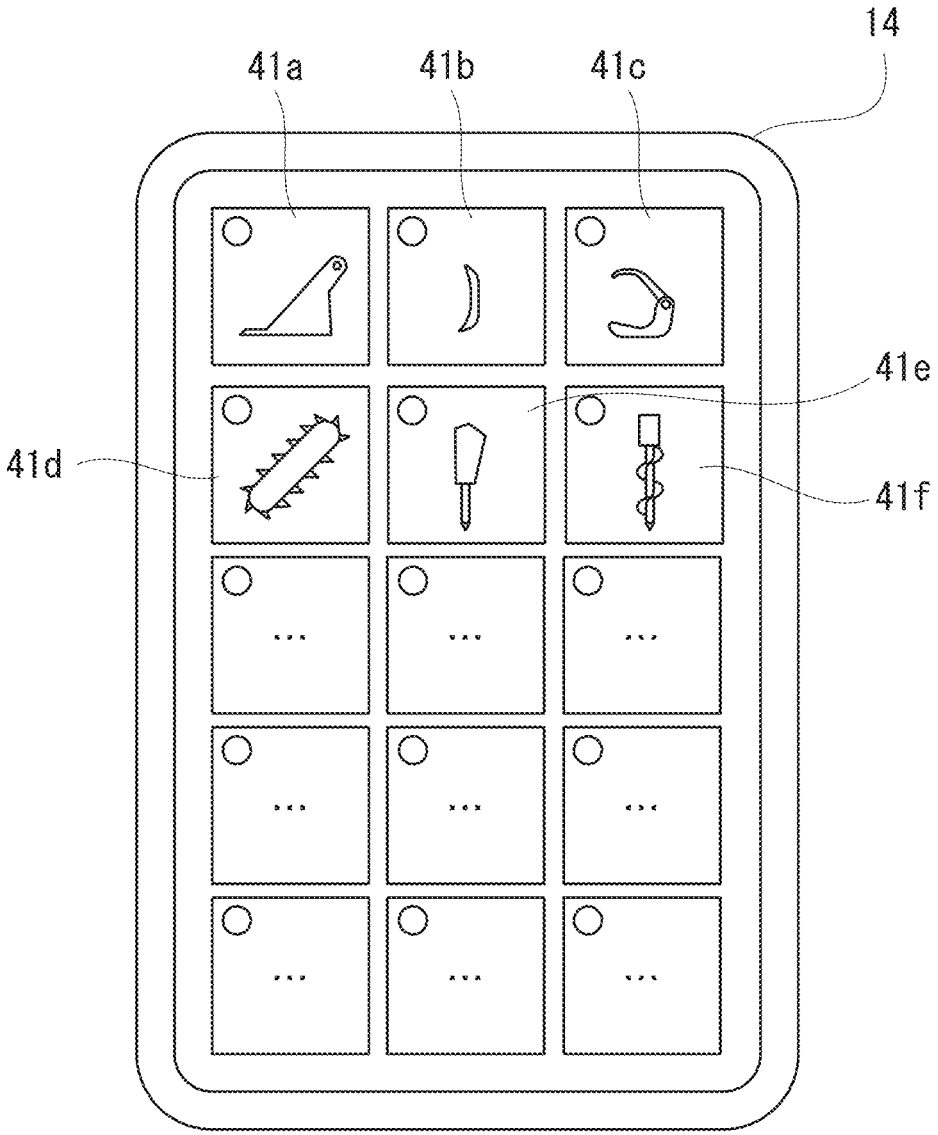
FIG. 11 schematically illustrates a display of a working machine according to the first example embodiment of the present invention that displays icons of the attachment list.

As illustrated in FIG. 11, the attachment list includes a plurality of icons including pictograms representing the work attachments 41*a* and the like, and the plurality of icons are displayed on the display 14 such that they are selectable by touching it. Note that the plurality of icons in the attachment list illustrated in FIGS. 10 and 11 include an icon including the pictogram of the bucket 41*a*, an icon including the pictogram of the dozer blade 41*b*, an icon including the pictogram of the grapple 41*c*, an icon including the pictogram of the trencher 41*d*, an icon including the pictogram of the hydraulic breaker 41*e*, and an icon including the pictogram of the earth auger 41*f*, which are examples.

The display 14 is a touchscreen monitor as described earlier, and therefore the controller 13 (arithmetic controller 130) is configured or programmed to, when the user selects (touches) the icon of the work attachment 41*a* etc. for use (attachment connected to the arm(s) 40) from the attachment list displayed on the display 14, recognize the model of the work attachment 41*a* or the like for use (selected work attachment 41*a* or the like) and, in the case where the recognized model is a work attachment 41*c* or the like to perform work during travel, retrieve (read) the reference load P1, P2 or the like of the work attachment 41*c* or the like which corresponds to the selected icon from the storing unit 131 (second storing unit 131*b*).

The controller 13 is configured or programmed also to, if the travel state during work and travel differs from the instruction (indication) provided by the user operation of the first manual operator 11, bring the travel state of the machine body 2 into agreement with the instruction provided by the operation of the first manual operator 11. That is, the controller 13 corrects the travel state of the machine body 2 to cause the machine body 2 to travel as intended by the user.

The following specifically discusses a process performed by the controller 13 when work is performed during travel. When the working machine 1 according to the present example embodiment performs work using the work attachment 41*a* or the like, the working machine 1 performs such work in the low-speed mode to reduce impacts and increases in load that would result from the contact (interference) with the work target object. Accordingly, in the case of performing work at a fixed position or performing work during travel, the user uses the transmission switch 80 to select the low-speed mode.

Figure 12:
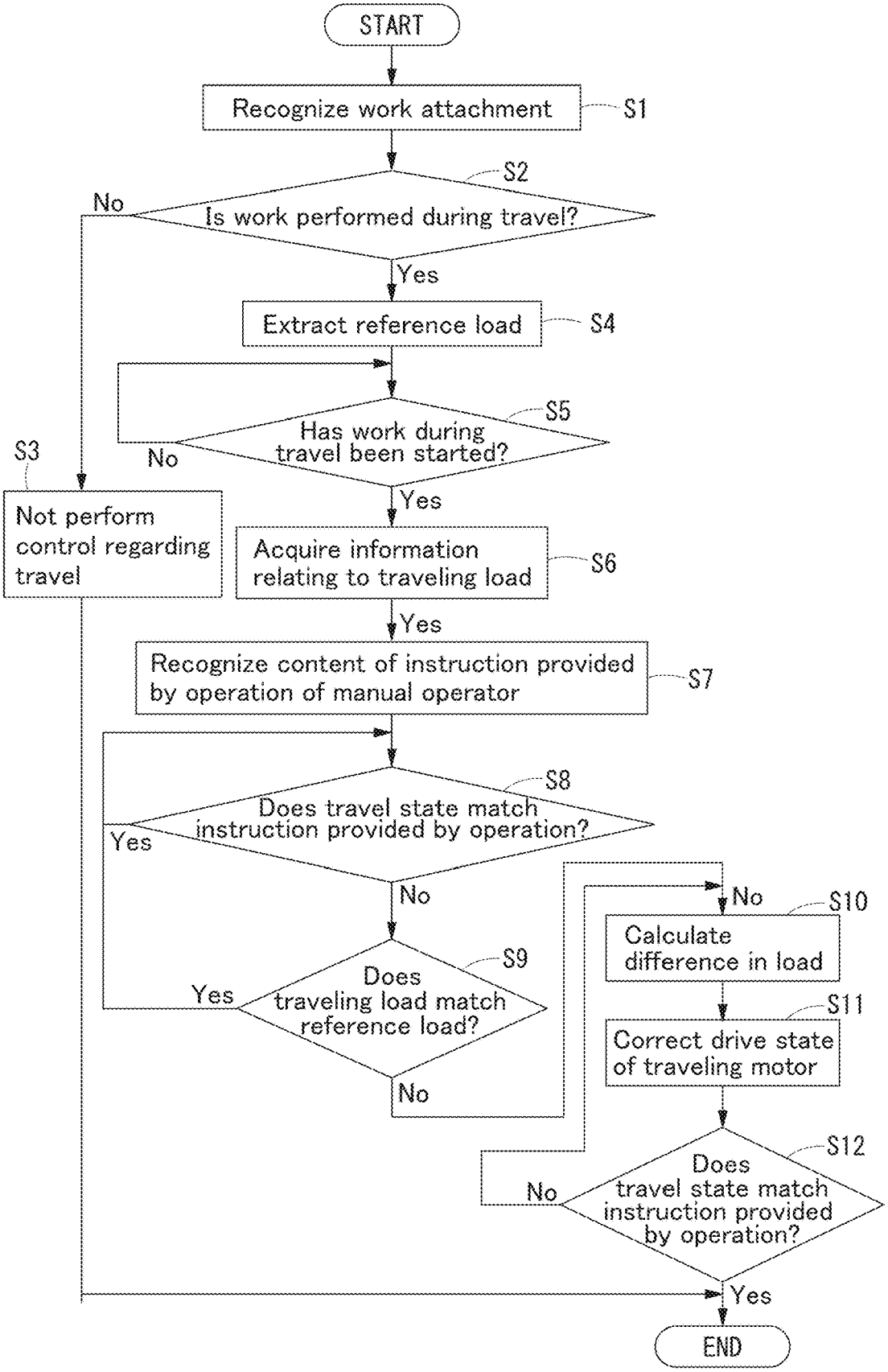
FIG. 12 is a flowchart schematically illustrating a process performed by a controller of a working machine according to the first example embodiment of the present invention.

The user then selects the work attachment 41*a* or the like to perform work from the attachment list displayed on the display 14. Accordingly, as illustrated in FIG. 12, the controller 13 recognizes the model of the selected work attachment 41*a* or the like (S1) and determines whether the recognized work attachment 41*a* or the like is for use in performing work during travel (S2).

If the recognized work attachment 41*e* or the like is not for use in performing work during travel (NO at S2), the controller 13 recognizes that the work to be performed does not involve travel (recognizes that the work is performed in response to user operations), and does not perform control regarding travel (S3) until the work ends (END).

If the recognized work attachment 41*a* is for use in performing work during travel (YES at S2), the controller 13 reads the attachment list from the storing unit 131 (second storing unit 131*b*) and extracts the reference load P1 or the like corresponding to the recognized work attachment 41*a* (S4).

The controller 13 then determines whether work during travel has been started (S5), and, if the controller 13 determines that work during travel has been started (YES at S5), acquires information relating to traveling loads on the traveling devices 3 (S6). It is noted here that whether the work during travel has been started (travel has been started) is determined by determining whether or not a load is imposed on each traveling motor 34 (50) based on the detection results from the pressure detection sensors S in the pair of fluid passages R1*a* and R1*b* connecting the second hydraulic pump 56 of the HST 54 and the traveling motor 34 (50) of each driver D. That is, when the traveling motor 34 (50) switches from the stopped state to the driven state, the pressure of hydraulic fluid supplied to the traveling motor 34 (50) increases (pressure rises), and therefore the controller 13 determines whether the traveling state has been entered using the detection result from the pressure detection sensors S. Furthermore, as described earlier, the pressure of hydraulic fluid supplied to the traveling motor 34 (50) also changes depending on the travel state of the traveling devices 3. Accordingly, the controller 13 acquires the detection results from the pressure detection sensors S in the pair of fluid passages R1*a* and R1*b* as information relating to the traveling load (S6).

The working machine 1 according to the present example embodiment includes the pair of left and right traveling devices 3. Therefore, the controller 13 acquires, as the information relating to the traveling loads, the values of the pressure of hydraulic fluid from the pressure detection sensors S in the pair of fluid passages R1*a* and R1*b* of the first driver DR and the pressure detection sensors S on the pair of fluid passages R1*a* and R1*b* of the second driver DL (S6).

Furthermore, the controller 13 recognizes the content of an instruction provided by the operation of the first manual operator 11 which is to be operated in relation to travel (S7). In the present example embodiment, the first hydraulic circuit 5A includes the plurality of pump control valves 57 and the like operably connected to the first operation lever 110. Therefore, the controller 13 recognizes the content of the instruction provided by the operation of the first manual operator 11 (the user's intension) based on the actuation state of the pump control valves 57 etc. In this regard, the content of the instruction provided by the operation of the first operation lever 110 can be recognized by, for example, providing sensor(s) to acquire the actuation state of the pump control valves 57 and/or providing sensor(s) to detect the flow state of pilot hydraulic fluid flowing through the pump control valves 57, although this is not described above.

The controller 13 then determines whether the travel state of the traveling devices 3 matches the instruction provided by the operation of the first manual operator 11 (S8). That is, the controller 13 determines whether the travel state of the traveling devices 3 is appropriate or not (S8), because, during work and travel, a load may be imposed on a position deviated from the center of the traveling working machine 1 (machine body 2) due to, for example, an interference between the work attachment 41*a* and the work target object, and the working machine 1 (machine body 2) may not travel in the direction as intended by the user.

The working machine 1 according to the present example embodiment includes the pair of lest and right traveling devices 3. Therefore, for example, in the case where the operation of the first manual operator 11 indicates straight travel (straight, forward travel), the pair of left and right traveling devices 3 need to travel at the same speed. However, if the pair of left and right traveling devices 3 differ from each other in terms of speed, the traveling devices 3 do not travel straight, even if the operation of the first manual operator 11 indicates the straight travel (straight, forward travel). In the case where the operation of the first manual operator 11 indicates traveling on a left curve or a right curve or making a left turn or a right turn, the pair of left and right traveling devices 3 need to travel at different speeds depending on the turn radius. However, if the working machine 1 is trying to make a turn with a turn radius differing from the instruction provided by the operation of the first manual operator 11, which means that the pair of left and right traveling devices 3 are traveling at different speeds having a difference not corresponding to the turn radius as indicated by the operation.

With this, the controller 13 determines whether the travel state of the working machine 1 (machine body 2) matches the instruction provided by the operation of the first manual operator 11, based on a combination (speed difference) of the travel states of the pair of traveling devices 3 (S8). The speed difference between the pair of traveling devices 3 corresponds to the difference between the loads on the pair of traveling devices 3 (traveling motors 34 (50)). Therefore, the controller 13 determines whether the travel state of the working machine 1 (machine body 2) matches the instruction provided by the operation of the first manual operator 11 using the detection results from the pair of pressure detection sensors S (the pair of pressure detection sensors S in the pair of fluid passages R1*a* and R1*b* connecting the hydraulic pump 56 and the traveling motor 34 (50)) of each of the first and second drivers DR and DL (S8).

If the controller 13 determines that the travel state of the traveling devices 3 differs from the instruction provided by the operation of the first manual operator 11 (NO at S8), the controller 13 compares the extracted reference load P1, P2 or the like and the actual traveling load on the traveling devices 3 (detection results from the pair of pressure detection sensors S). If the controller 13 determines that the extracted reference load P1, P2 or the like differs from the actual traveling load on the traveling devices 3 (detection results from the pair of pressure detection sensors S) (NO at S9), the controller 13 calculates the difference (difference in load) between the reference load P1, P2 or the like and the actual traveling load on the traveling devices 3 (detection results from the pair of pressure detection sensors S) (S10).

The controller 13 then changes the drive state of the traveling motor 34 (50) of one of the pair of traveling devices 3 in order to correct the difference in load (S11). Specifically, the controller 13 increases the rotational speed of the traveling motor 34 (50) of the traveling device 3 which is subjected to a heavier traveling load to a higher rotational speed (S11). Specifically, as the traveling load increases, the measurement results from the rotation sensors 35L and 35R (rotational speed of the traveling motor 34 (50)) decreases. Therefore, the controller 13 increases the speed of the traveling motor 34 (50) of the traveling device 3 which is subjected to a heavier traveling load, based on the measured results from the rotation sensors 35L and 35R (S11). Accordingly, the drive rotational speed of the traveling device 3 (drive rotational speed of the crawler belt 33 in the present example embodiment) also becomes a higher drive rotational speed.

More specifically, the working machine 1 according to the present example embodiment enters the low-speed mode when performing work during travel. Therefore, the controller 13 issues an instruction to bring the drive rotational speed of the traveling device 3 subjected to a heavier traveling load to a drive rotational speed higher than (i) the drive rotational speed of the traveling devices 3 corresponding to the travel speed corresponding to the operation of the first manual operator 11 and than (ii) the drive rotational speed of the traveling devices 3 corresponding to the travel speed of the machine body 2 (working machine 1) in the low-speed mode. That is, the controller 13 brings the drive rotational speed of the traveling device 3 subjected to a heavier traveling load to a drive rotational speed higher than (i) the drive rotational speed of the traveling devices 3 that achieves the travel speed corresponding to the operation of the first manual operator 11 and than (ii) the drive rotational speed of the traveling devices 3 that achieves a low reference travel speed of the working machine 1 (machine body 2) that is lower than a predetermined reference speed.

In the present example embodiment, each traveling motor 34 (50) changes its rotational speed based on the flow rate of hydraulic fluid delivered from the corresponding second hydraulic pump 56, and therefore the controller 13 causes the second hydraulic pumps 56 to change the delivery flow rate of hydraulic fluid (S11). In the present example embodiment, the second hydraulic pump 56 is supplied with pilot hydraulic fluid from the pilot fluid passage(s) connected to the shuttle valve(s) 58 to change the delivery flow rate and direction, and therefore the controller 13 sends an instruction to the pilot pressure adjustment valve(s) 72 in the pilot fluid passage(s) to change the pilot pressure. Accordingly, the pilot pressure adjustment valve(s) 72 adjusts the pressure of pilot hydraulic fluid so that the second hydraulic pump 56 delivers hydraulic fluid at a flow rate that causes the traveling motor 34 to rotate at a rotational speed compensating for the difference in load. With this, the second hydraulic pump 56 of the first driver DR or the second driver DL delivers hydraulic fluid at an appropriate flow rate, and the travel state of the pair of traveling devices 3 (the difference between the drive states of the pair of traveling motors 34 (50)) is corrected (S11). With this, the working machine 1 (machine body 2) travels in the travel state according to the instruction provided by the operation of the first manual operator 11.

When work during travel is continuously performed, work environments and/or traveling environments may change, and the travel state of the working machine 1 (machine body 2) may become different from the instruction provided by the operation of the first manual operator 11. Accordingly, the controller 13 corrects the difference between the traveling loads on the pair of traveling devices 3 (loads on the pair of traveling motors 34 (50)) (S11), and then determines whether the travel state of the working machine 1 (machine body 2) matches the instruction provided by the operation of the first manual operator 11 (S12). Also in such a case, if the controller 13 determines that the travel state of the working machine 1 (machine body 2) differs from the instruction provided by the operation of the first manual operator 11 (NO at S12), the controller 13 repeatedly performs the following until work ends (END): calculating the difference between traveling loads on the pair of traveling devices 3 (difference between the loads on the pair of traveling motors 34 (50)) (S8); and correcting the drive of the traveling motor(s) 34 (50) (S11).

Thus, the controller 13 performs control to bring the travel state of the working machine 1 (machine body 2) into agreement with the instruction provided by the operation of the first manual operator 11, and therefore the working machine 1 (machine body 2) behaves as intended by the user when performing work during travel. Therefore, the user can perform work during travel as intended without having to perform an operation to correct the travel state of the working machine 1.

It is noted here that, when the working machine 1 performs work during travel, the resistance force would increase due to the interference between the work attachment 41*a* or the like and the work target object, as described earlier. Accordingly, the driving force of the traveling devices 3 (traveling motors 34 (50)) may exceed the contact resistance between the traveling devices 3 (crawler belt 33 in the case where the traveling devices 3 are crawler traveling devices) and the ground, and the traveling devices 3 may skid. For example, when the bucket 41*a* or the dozer blade 41*b* etc. presses earth and sand or soil, the resistance increases, and at least one of the pair of traveling devices 3 may skid and the working machine 1 may become unable to travel as intended by the user.

In view of this, in the working machine 1 according to the present example embodiment, the controller 13 performs control such that, if the pair of traveling devices 3 skid, such a skidding state is eliminated.

Figure 13:
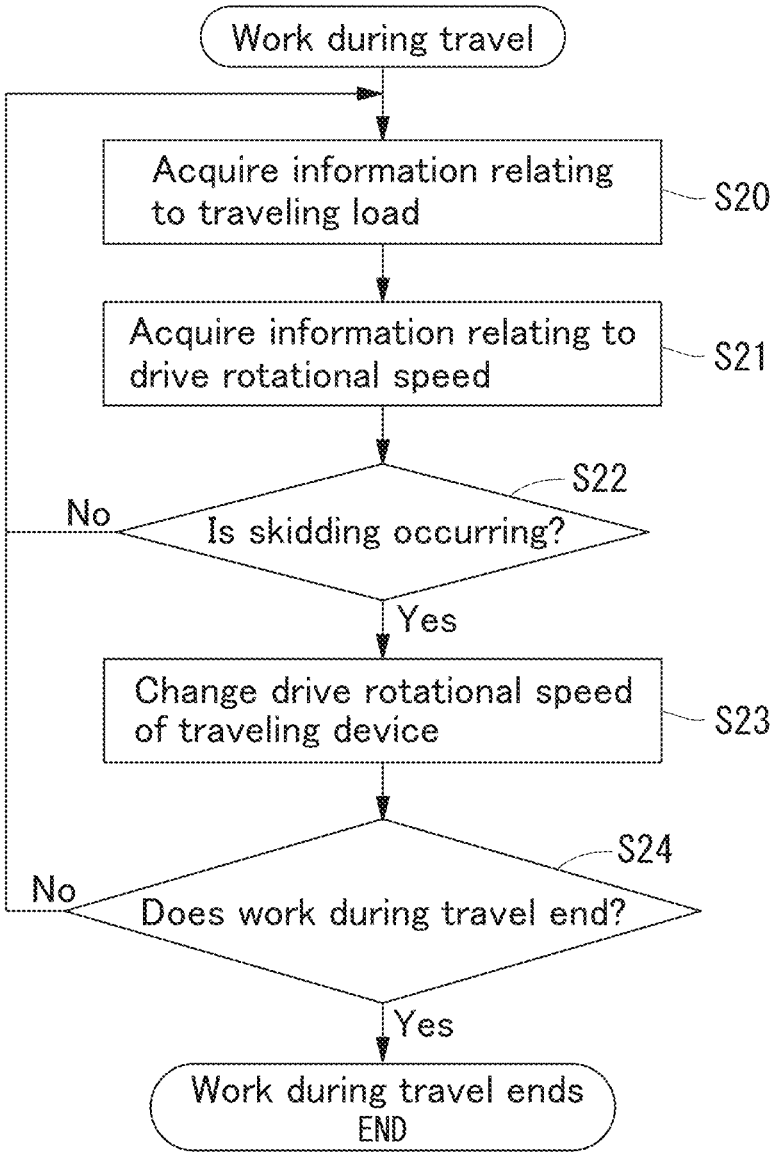
FIG. 13 is a flowchart schematically illustrating a process performed by a controller of a working machine according to the first example embodiment of the present invention.

Specifically, as illustrated in FIG. 13, while the working machine 1 is performing work during travel, the controller 13 acquires information relating the traveling loads on the pair of traveling devices 3 from the pressure detection sensors S and acquires information relating to the drive rotational speeds from the rotation sensors 35L and 35R (S20, S21). Specifically, the traveling loads on the traveling devices 3 correspond to the loads on the traveling motors 34 (50) that drive the traveling devices 3. Therefore, in the present example embodiment, the controller 13 acquires the detection results from the pressure detection sensors S to detect the pressure of hydraulic fluid flowing through fluid passages connecting the corresponding second hydraulic pump 56 and the corresponding traveling motor 34 (50) as the information relating to the traveling load on the corresponding traveling device 3, and acquires the output rotational speeds of the traveling motors 34 (50) as the drive rotational speeds from the rotation sensors 35L and 35R.

The controller 13 then determines whether the traveling devices 3 are skidding based on the relationship between the traveling loads on the traveling devices 3 and the drive rotational speeds of the traveling devices 3 (S22). In the present example embodiment, if the traveling load on one of the pair of traveling devices 3 is equal to or more than a predetermined value, the drive rotational speed of the one of the pair of traveling devices 3 is less than a predetermined rotational speed, the traveling load on the other traveling device 3 is less than the predetermined value, and the drive rotational speed of the other traveling device 3 is equal to or higher than the predetermined rotational speed, the controller 13 determines that the other traveling device 3 is skidding (YES at S22). In contrast, if the above condition is not satisfied, the controller 13 determines that neither of the pair of traveling devices 3 is skidding (NO at S22).

Specifically, if the traveling load on the left traveling device 3 is equal to or more than the predetermined specified value, the drive rotational speed of the left traveling device 3 is less than the predetermined rotational speed, the traveling load on the right traveling device 3 is less than the predetermined value, and the drive rotational speed of the right traveling device 3 is equal to or higher than the predetermined rotational speed, the controller 13 determines that the right traveling device 3 is skidding (YES at S22). If the traveling load on the right traveling device 3 is equal to or more than the predetermined value, the drive rotational speed of the right traveling device 3 is less than the predetermine rotational speed, the traveling load on the left traveling device 3 is less than the predetermined value, and the drive rotational speed of the left traveling device 3 is equal to or higher than the predetermined rotational speed, the controller 13 determines that the left traveling device 3 is skidding (YES at S22).

If the controller 13 determines that a traveling device 3 is skidding (YES at S22), the controller 13 changes the drive rotational speed of the traveling device 3 determined as skidding to a drive rotational speed lower than the current drive rotational speed (S23). Specifically, the controller 13 sets the drive rotational speed of the other traveling device 3 determined as skidding to a drive rotational speed lower than the drive rotational speed of the opposite traveling device 3 (the one of the traveling devices 3) (S23). Assuming such settings, in the present example embodiment, the pair of traveling devices 3 may each be driven at a drive rotational speed lower than the drive rotational speed corresponding to the operation of the first manual operator 11. In the present example embodiment, however, the controller 13 drives the one of the traveling devices 3 not determined as skidding at a drive rotational speed corresponding to the operation of the first manual operator 11, and drives the other traveling device 3 determined as skidding at a drive rotational speed lower than the drive rotational speed corresponding to the operation of the first manual operator 11 (S23).

When the drive rotational speed of the traveling device 3 determined as skidding is reduced to a low rotational speed as such, the skidding state of the traveling device 3 is improved, and the state of the working machine 1 performing work and travel (the travel state of the working machine 1) is also improved. Specifically, a traveling device 3 skids when the drive torque of the traveling device 3 is greater than the resistance (frictional resistance) between the traveling device 3 (crawler belt 33) and the ground. Therefore, when the drive rotational speed of the skidding traveling device 3 is reduced as described above to reduce the drive torque of the traveling device 3 to cause the drive torque to approach the contact resistance (more accurately, the resistance force along the direction of travel) between the traveling device 3 (crawler belt 33) and the ground or to decrease below the contact resistance, the skidding state is improved. Note, however, that if the contact resistance between the traveling device 3 and the ground is small (in the case where the frictional resistance is small), the range of driving forces that can achieve traction, despite the small resistance force caused by the interference between the work attachment 41*a* and the work target object, is limited.

In the present example embodiment, the pair of traveling devices 3 are driven by the pair of hydraulic motors 50 (34) supplied with hydraulic fluid from the pair of second hydraulic pumps 56, and therefore the drive rotational speeds of the traveling devices 3 are changed by adjusting the delivery flow rate of hydraulic fluid from the second hydraulic pumps 56.

Specifically, if the controller 13 determines that the other traveling device 3 is skidding, the controller 13 causes the delivery flow rate of hydraulic fluid from the second hydraulic pump 56 that supplies hydraulic fluid to the other traveling device 3 (traveling motor 34 (50)) determined as skidding to be smaller than the delivery flow rate of hydraulic fluid from the second hydraulic pump 56 which supplies hydraulic fluid to the one of the traveling devices 3 (traveling motors 34 (50)). The delivery flow rate of hydraulic fluid from the second hydraulic pump 56 is adjusted by supplying the second hydraulic pump 56 (pressure receiver(s) 56*b*, 56*c*) with pilot hydraulic fluid having a pressure based on an instruction from the controller 13 using the pilot pressure adjustment valve(s) 72.

After changing the drive rotational speed of the traveling device 3 (S23), the controller 13 determines whether the work during travel ends (S24), and repeats the following until the work during travel ends (YES at S24, END): determining whether the traveling device(s) 3 is skidding; and making a correction (S20 to S23).

The working machines 1 according to the present example embodiments have been described so far. As described above, the controller 13 is configured or programmed to perform control while work is performed during travel, so that the travel behavior as intended by the user is achieved when the work during travel is performed.

Specifically, in the example embodiments described, a working machine 1 includes a machine body 2 to attach a work attachment 41*a* or the like thereto, a pair of traveling devices 3 to support opposite side portions of the machine body 2 such that the machine body 2 is allowed to travel, the pair of traveling devices 3 being operable to be driven independently of each other, a manual operator (first manual operator) 11 to be operated by a user in relation to travel of the machine body 2, and a controller 13 configured or programmed to perform control relating to the travel of the machine body 2, wherein the controller 13 is configured or programmed to, while the manual operator (first manual operator) 11 is operated in relation to the travel of the machine body 2, drive the pair of traveling devices 3 independently of each other based on at least one of a state of the machine body 2 or a state of the pair of traveling devices 3 to bring a travel state of the machine body 2 into agreement with an instruction provided by operation of the manual operator (first manual operator) 11.

With the above configuration, the pair of traveling devices 3 are capable of being driven independently of each other, and therefore the drive states of the pair of traveling devices 3 can be changed independently of each other. The controller 13 drives the pair of traveling devices 3 independently based on at least the state of the machine body 2 or the state of the pair of traveling devices 3 while the manual operator (first manual operator) 11 is operated in regard to the travel of the machine body 2 to bring the travel state of the machine body 2 into agreement with an instruction provided by the operation of the manual operator (first manual operator) 11. Therefore, in the case where the travel state of the machine body 2 differs from the instruction provided by the operation of the manual operator (first manual operator) 11 due to the resistance force resulting from the interference (contact) between the work attachment 41*a* or the like and the work target object when work during travel is performed by the work attachment 41*a* or the like, the travel state of the machine body 2 is brought into the state as indicated by the operation of the manual operator (first manual operator) 11.

In the example embodiments described, the controller 13 may be configured or programmed to, while the manual operator (first manual operator) 11 is operated to cause the machine body 2 to travel straight, if the state of the machine body 2 differs from the instruction provided by the operation of the manual operator (first manual operator) 11, drive the pair of traveling devices 3 such that outputs of the pair of traveling devices 3 differ from each other to bring the travel state of the machine body 2 into agreement with the instruction provided by the operation of the manual operator (first manual operator) 11. With this, the travel state of the machine body 2 (working machine 1) is brought into the travel state as indicated by the operation of the manual operator (first manual operator) 11. That is, when the manual operator (first manual operator) 11 is operated to indicate straight travel (forward travel or rearward travel), the machine body 2 (working machine 1) travels straight forward or rearward.

The controller 13 may be configured or programmed to, while the manual operator (first manual operator) 11 is operated to cause the machine body 2 to travel straight, if traveling loads on the pair of traveling devices 3 differ from each other during the travel of the machine body 2, determine that the state of the machine body 2 differs from the instruction provided by the operation of the manual operator (first manual operator) 11. With this, it is possible to determine whether the machine body 2 is traveling straight using the traveling loads on the pair of traveling devices 3 without having to use a lot of information.

In the example embodiments described, the controller 13 may be configured or programmed to, if the state of the machine body 2 differs from the instruction provided by the operation of the manual operator (first manual operator) 11 while the manual operator (first manual operator) 11 is operated to cause the machine body 2 to travel straight, drive a first one of the pair of traveling devices 3 that is subjected to a greater traveling load at a drive rotational speed higher than a drive rotational speed of a second one of the pair of traveling devices 3 that is subjected to a smaller traveling load to bring the travel state of the machine body 2 into agreement with the instruction provided by the operation of the manual operator (first manual operator) 11. With this, it is possible to cause the machine body 2 to travel (travel straight) as indicated by the operation (operation to achieve straight travel) of the manual operator (first manual operator) 11. That is, in the case where the state of the machine body 2 differs from the instruction provided by the operation of the manual operator (first manual operator) 11 while the manual operator (first manual operator) 11 is operated to cause the machine body 2 to travel straight, the machine body 2 is trying to turn left or right from the direction of travel. By causing the drive rotational speed of one of the traveling devices 3 that is subjected to a heavy traveling load to be higher than the drive rotational speed of the other traveling device 3 subjected to a light traveling load as described above, it is possible to correct the direction of travel of the machine body 2 (working machine 1) and allow the machine body 2 (working machine 1) to travel straight.

In the example embodiments described, the controller 13 may be configured or programmed to determine whether the traveling loads on the pair of traveling devices 3 differ from each other by comparing a preset reference load P1, P2, or the like and the traveling load on at least one of the pair of traveling devices 3 during the travel of the machine body 2. With this, it is possible to determine whether the actual traveling load on the traveling devices 3 during travel matches the reference load P1, P2 or the like that would be imposed when the traveling devices 3 are traveling as indicated by the operation of the manual operator (first manual operator) 11. That is, it is possible to determine whether the traveling devices 3 which are traveling are in the intended travel state.

In the example embodiments described, the machine body 2 may be configured to attach thereto and detach therefrom a work attachment 41*a* or the like to perform specific work such that the work attachment 41*a* or the like is replaceable with any of a plurality of types of work attachments 41*a* and the like to perform different types of work differing from the specific work. The controller 13 may be configured or programmed to extract a reference load P1, P2 or the like for the work attachment 41*a* or the like attached to the machine body 2 from a plurality of preset reference loads P1, P2, and the like for a plurality of types of work attachments 41*a* and the like, and determine whether the traveling loads on the pair of traveling devices 3 differ from each other by comparing the extracted reference load P1, P2 or the like and the traveling load on at least one of the pair of traveling devices 3 during the travel of the machine body 2. When the work attachment 41*a* or the like is replaced with another one, the state of contact (interference) between the work attachment 41*a* or the like and the work target object may change. Accordingly, how the traveling loads are imposed on the traveling devices 3 during work and travel (during travel) may also change. However, since the travel state of the traveling devices 3 is changed based on the reference load P1, P2 or the like corresponding to the attached work attachment 41*a* or the like, even when the work attachment 41*a* or the like is replaced with another one, it is possible to bring the travel state of the machine body 2 into agreement of the operation of the manual operator (first manual operator) 11.

In the example embodiments above, the controller 13 may be configured or programmed to recognize a type of the work attachment 41*a* or the like attached to the machine body 2. The plurality of preset reference loads P1, P2 and the like are set based on respective work characteristics and/or respective work conditions of the plurality of types of work attachments 41*a* and the like. With this, the plurality of reference loads P1, P2 and the like are highly accurate references in consideration of environments and conditions in which work during travel is performed by the work attachments 41*a* and the like. With this, the result of comparison between the reference load P1, P2 or the like and the traveling devices 3 is highly accurate.

In the example embodiments described, the pair of traveling devices 3 may include respective drive motors (traveling motors) 34. The controller 13 may be configured or programmed to recognize loads on the drive motors (traveling motors) 34 of the pair of traveling devices 3 during the travel of the machine body 2 as the traveling loads on the pair of traveling devices 3. The traveling loads on the traveling devices 3 may increase or decrease due to, for example, the contact resistance at the ground or the resistance (reaction force) resulting from the contact (interference) between the work attachment 41*a* or the like and the work target object. The drive motors (traveling motors) 34 to drive the traveling devices 3 are driven against, for example, the contact resistance at the ground or the resistance (reaction force) resulting from the contact (interference) between the work attachment 41*a* or the like and the work target object. Therefore, the loads on the drive motors (traveling motors) 34 correspond to the traveling loads. Thus, it is possible to evaluate the travel state of the machine body 2 (working machine 1) using the loads on the drive motors (traveling motors) 34 as the traveling loads, without having to acquire other information.

In the example embodiments described, the drive motors (traveling motors) 34 may include hydraulic motors 50. The reference loads P1, P2 and the like may be values of hydraulic pressure. The loads on the drive motors (traveling motors) 34 may be values of a pressure of hydraulic fluid supplied to the hydraulic motors (traveling motors) 34. In the case where the drive motors (traveling motors) 34 are hydraulic motors 50, the pressure of hydraulic fluid supplied to the hydraulic motors 50 changes depending on the loads on the hydraulic motors 50. Therefore, in the case where the drive motors (traveling motors) 34 are the hydraulic motors 50, it is possible to correctly evaluate the travel state of the machine body 2 (working machine 1) using the reference load P1, P2 or the like which is the value of hydraulic pressure and the actual traveling load which is the value of the pressure of hydraulic fluid supplied to the hydraulic motors 50.

In the example embodiments above, the working machine 1 may further include a hydraulic pump (second hydraulic pump) 56 to supply hydraulic fluid to the hydraulic motors 50. The values of the pressure of hydraulic fluid may be values of a pressure of hydraulic fluid supplied from the hydraulic pump (second hydraulic pump) 56 to the hydraulic motors 50. The value of the pressure of hydraulic fluid supplied from each hydraulic pump (second hydraulic pump) 56 to the hydraulic motor 50 changes depending on the load on the hydraulic motor 50. That is, the value of the pressure of hydraulic fluid supplied from the hydraulic pump (second hydraulic pump) 56 to the hydraulic motor 50 changes depending on the actual traveling loads on the traveling devices 3. Therefore, the value of the pressure of hydraulic fluid supplied from the hydraulic pumps (second hydraulic pumps) 56 to the hydraulic motors 50 can be said to be information relating to the actual traveling loads on the traveling devices 3. By evaluating the travel state of t the traveling devices 3 based on the value of the pressure of hydraulic fluid, it is possible to accurately identify the travel state of the travel of the machine body 2 (working machine 1).

In the example embodiments above, the controller 13 may be configured or programmed to enter a low-speed mode in which the controller 13 causes the machine body 2 to travel at a reference speed lower than a predetermined reference speed, and when in the low-speed mode, drive one of the pair of traveling devices 33 that is subjected to the greater load at a drive rotational speed higher than a drive rotational speed corresponding to a travel speed corresponding to the operation of the manual operator (first manual operator) 11 and than a drive rotational speed corresponding to a travel speed of the machine body 2 in the low-speed mode. When the traveling load on a traveling device 3 is large, the drive rotational speed of the traveling device 3 is lower than a predetermined rotational speed due to the traveling load (resistance). Therefore, by causing the drive rotational speed of the traveling device 3 subjected to a heavy traveling load to be higher than the drive rotational speed of the traveling devices 3 corresponding to the travel speed corresponding to the operation of the manual operator (first manual operator) 11 and higher than the drive rotational speed of the traveling devices 3 corresponding to the travel speed of the machine body 2 in the low-speed mode as described above, it is possible to correct the drive rotational speed of the traveling device 3 subjected to the heavy traveling load and regain the predetermined travel state.

In the example embodiments described, the controller 13 may be configured or programmed to, in a case that the state of the machine body 2 differs from the instruction provided by the operation of the manual operator (first manual operator) 11, drive the pair of traveling devices 3 such that outputs of the pair of traveling devices 3 differ from each other to bring the travel state of the machine body 2 into agreement with the instruction provided by the operation of the manual operator (first manual operator) 11. With this, the travel state of the machine body 2 (working machine 1) is brought into agreement with the instruction provided by the operation of the manual operator (first manual operator) 11. That is, when the manual operator (first manual operator) 11 is operated to indicate straight travel (forward travel or rearward travel), the machine body 2 (working machine 1) travels straight forward or rearward. When the manual operator (first manual operator) 11 is operated to indicate making a curve, a left turn, or a right turn, the machine body 2 (working machine 1) travels in the direction as indicated by the operation of the manual operator (first manual operator) 11 with a turn radius as indicated by the operation of the manual operator (first manual operator) 11.

In the example embodiments described, the controller 13 may be configured or programmed to, if a traveling load on a first one of the pair of traveling devices 3 is equal to or more than a predetermined value, a drive rotational speed of the first one of the pair of traveling devices 3 is less than a predetermined rotational speed, a traveling load on a second one of the pair of traveling devices 3 is less than the predetermined value, and a drive rotational speed of the second one of the pair of traveling devices 3 is equal to or higher than the predetermined rotational speed, set the drive rotational speed of the second one of the pair of traveling devices 3 to a drive rotational speed lower than the drive rotational speed of the first one of the pair of traveling devices 3. When the drive torque of the traveling devices 3 is greater than the contact resistance at the ground, the traveling devices 3 may skid, and drive rotational speeds become high (drive rotational speeds increase). When a traveling device 3 is skidding, the traveling device 3 is just rotating, and therefore the traveling load is low. Therefore, when the traveling load on one of the pair of traveling devices 3 is equal to or more than a predetermined value, the drive rotational speed of the one traveling device 3 is less than a predetermined rotational speed, the traveling load on the other traveling device 3 is less than the predetermined value, and the drive rotational speed of the other traveling device 3 is equal to or higher than the predetermined rotational speed, the one traveling device 3 is traveling but the other traveling device 3 is skidding. Therefore, in such a case, the controller 13 sets the drive rotational speed of the other traveling device 3 to a drive rotational speed lower than the drive rotational speed of the one traveling device 3, so that the skidding of the other traveling device 3 is improved.

In the example embodiments described, the controller 13 may be configured or programmed to, if a traveling load on a first one of the pair of traveling devices is equal to or more than a predetermined value, a drive rotational speed of the first one of the pair of traveling devices 3 is less than a predetermined rotational speed, a traveling load on the second one of the pair of traveling devices 3 is less than the predetermined value, and a drive rotational speed of the second one of the pair of traveling devices 3 is equal to or higher than the predetermined rotational speed, drive the first one of the pair of traveling devices 3 at a drive rotational speed corresponding to the operation of the manual operator (first manual operator) 11 and drive the second one of the pair of traveling devices 3 at a drive rotational speed lower than the drive rotational speed corresponding to the operation of the manual operator (first manual operator) 11. When the traveling load on the one of the pair of traveling devices 3 is equal to or more than the predetermined value, the drive rotational speed of the one traveling device 3 is less than the predetermined rotational speed, the traveling load on the other traveling device 3 is less than the predetermine value, and the drive rotational speed of the other traveling device 3 is equal to or higher than the predetermine rotational speed, the other traveling device 3 is skidding, as described earlier. Therefore, by driving the one traveling device 3 at the drive rotational speed corresponding to the operation of the manual operator (first manual operator) 11 and driving the other traveling device 3 at a drive rotational speed lower than the drive rotational speed corresponding to the operation of the manual operator (first manual operator) 11, it is possible to eliminate or reduce the skidding of the other traveling device 3 and cause the machine body 2 (working machine 1) to advance.

In the example embodiments described, the controller 13 may be configured or programmed to, if a traveling load on a first one of the pair of traveling devices 3 is equal to or more than a predetermined value, a drive rotational speed of the first one of the pair of traveling devices 3 is less than a predetermined rotational speed, a traveling load on the second one of the pair of traveling devices 3 is less than the predetermined value, and a drive rotational speed of the second one of the pair of traveling devices 3 is equal to or higher than the predetermined rotational speed, drive each of the pair of traveling devices 3 at a drive rotational speed lower than a drive rotational speed corresponding to the operation of the manual operator (first manual operator) 11. When the traveling devices 3 are driven at a drive rotational speed lower than the drive rotational speed corresponding to the operation of the manual operator (first manual operator) 11, the drive torque of the traveling devices 3 approaches the contact resistance between the traveling devices 3 and the ground, so that the skidding of the traveling devices 3 can be prevented or reduced.

In the example embodiments described, the working machine according 1 may further include a pair of hydraulic motors 50 to drive the respective pair of traveling devices 3, and a pair of hydraulic pumps (second hydraulic pumps) 56 to supply hydraulic fluid to the respective pair of hydraulic motors 50. The controller 13 may be configured or programmed to, if a traveling load on a first one of the pair of traveling devices 3 is equal to or more than a predetermined value, a drive rotational speed of the first one of the pair of traveling devices 3 is less than a predetermined rotational speed, a traveling load on the second one of the pair of traveling devices 3 is less than the predetermined value, and a drive rotational speed of the second one of the pair of traveling devices 3 is equal to or higher than the predetermined rotational speed, perform control such that a delivery flow rate of hydraulic fluid from a second one of the pair of hydraulic pumps (second hydraulic pumps) 56 to supply the hydraulic fluid to a second one of the pair of hydraulic motors (traveling motors) 34 (50) to drive the second one of the pair of traveling devices 3 is less than a delivery flow rate of hydraulic fluid from a first one of the pair of hydraulic pumps (second hydraulic pumps) 56 to supply the hydraulic fluid to a first one of the pair of hydraulic motors (traveling motors) 34 (5) to drive the first one of the pair of traveling devices 3. With this, the skidding of the traveling devices 3 can be prevented or reduced by merely controlling the flow rate of hydraulic fluid supplied to the hydraulic motors 50.

In the example embodiments described, the traveling loads on the pair of traveling devices 3 may be values of a pressure of hydraulic fluid supplied to the pair of hydraulic motors 50. The values of the pressure of hydraulic fluid may be values of a pressure of hydraulic fluid supplied from the pair of hydraulic pumps (second hydraulic pumps) 56 to the pair of hydraulic motors 50. As described earlier, the value of the pressure of hydraulic fluid supplied from the hydraulic pump(s) (second hydraulic pump(s)) 56 to the hydraulic motor(s) 50 changes depending on the loads on the hydraulic motor(s) 50. That is, the value of the pressure of hydraulic fluid supplied from the hydraulic pump(s) (second hydraulic pump(s)) 56 to the hydraulic motor(s) 50 changes depending on the actual traveling loads on the traveling device(s) 3. Therefore, the value of the pressure of hydraulic fluid supplied from the hydraulic pump(s) (second hydraulic pump(s)) 56 to the hydraulic motor(s) 50 can be said to be information relating to the actual traveling loads on the traveling device(s) 3. By evaluating the travel state of the traveling devices 3 based on the value of the pressure of hydraulic fluid, it is possible to accurately identify the travel state of the machine body 2 (working machine 1).

In the example embodiments described, the controller 13 may be configured or programmed to, while the manual operator (first manual operator) 11 is operated to cause the pair of traveling devices 3 to travel straight forward, if the state of the machine body 2 differs from the instruction provided by the operation of the manual operator (first manual operator) 11, drive the pair of traveling devices 3 such that outputs of the pair of traveling devices 3 differ from each other to bring the travel state of the machine body 2 into agreement with the instruction provided by the operation of the manual operator (first manual operator) 11. This makes it possible to cause the machine body 2 to travel straight in accordance with the instruction provided by the operation of the manual operator (first manual operator) 11.

Note that the present invention is not limited to the example embodiments described above and can be modified without departing from the spirit of the present invention.

For example, in the example embodiments described above, the traveling motors (drive sources) 34 to drive the respective pair of traveling devices 3 independently of each other are hydraulic motors 50, but this does not imply any limitation. For example, electric motors may be used as the drive sources to drive the pair of traveling devices 3. Also in such a case, the controller 13 controls the outputs of the electric motors which are the traveling motors (drive sources) 34, making it possible to achieve the same effects as the example embodiments described above.

In the example embodiments described above, a compact track loader including crawler traveling devices 3 is described as an example of the working machine 1. The working machine 1, however, is not limited to the compact track loader. For example, the working machine 1 may use tire traveling devices 3 (wheeled traveling devices 3). In such a case, the drive rotational speed of the traveling devices 3 indicates the rotational speed of tires which are driving wheels.

In such a case, the traveling devices 3 may include a pair of left and right wheels at each of the front and rear portions, one of the pairs of left and right wheels at one of the front and rear portions may be used as driving wheels driven by hydraulic motor(s), and the other of the pairs of left and right wheels may be used as steered wheels. The tire (wheeled) traveling devices 3 may be configured such that each of the pairs of left and right wheels at the front and rear portions is a driving wheel driven by a drive motor (traveling motor) and that the direction of travel is changed using the difference between the rotational speeds of the wheels (so-called skid-steer loader). Also in such a case, the drive motors (traveling motors) are provided for the respective driving wheels such that the pairs of left and right driving wheels are driven independently of each other. The working machine 1 may be another construction machine, an agriculture machine, a utility vehicle (UV), or the like, provided that the working machine 1 includes a working device 4 including a function portion.

In the example embodiments described above, the working machine 1 includes, as the seat-protecting mechanism 22, the cabin 22 which defines the operation room RM (space having specified dimensions in the widthwise direction, front-rear direction, and height direction) including the seat 21. Note, however, that this does not imply any limitation. For example, the seat-protecting mechanism 22 may be a so-called canopy or ROPS which includes pillars extending upward from the frame chassis 20 and a roof supported by the pillars above the seat 21.

In the example embodiments described above, the prime mover 10 to drive the hydraulic pump(s) is a diesel engine. Note, however, that this does not imply any limitation. The prime mover 10 may be another internal combustion engine such as a gasoline engine or a hydrogen engine. The prime mover 10 may be an electric motor instead of or in addition to an internal combustion engine. That is, the first hydraulic pump 53, the second hydraulic pump(s) 56, and the third hydraulic pump 64 may each be an electric hydraulic pump.

In the example embodiments described above, the second operation lever 120 is pivotable in the front-rear and left-right directions from the neutral position. Note, however, that this does not imply any limitation. For example, the second operation lever 120 may be pivotable also diagonally in four directions from the neutral position, and may be configured to actuate the hydraulic actuator(s) 51, 52 according to the direction in which the second operation lever 120 is pivoted diagonally in such directions. The second operation lever 120 may be pivotable in the front-rear and left-right directions and diagonally in four directions from the neutral position, and may be configured to actuate the hydraulic actuator(s) 51, 52 according to the direction in which the second operation lever 120 is pivoted. Thus, the second operation lever 120 pivotable in the front-rear and left-right directions and diagonally in the four directions makes it possible to increase the number of movement patterns of the hydraulic actuator(s) 51, 52.

In the example embodiments described above, the control valves to control the hydraulic actuators 51, 52, and 411*c* (first hydraulic cylinder(s) 51, second hydraulic cylinder(s) 52, and hydraulic cylinder(s) 411*c* of the work attachment(s) 41*c* and/or the like) are pilot pressure control valves actuated by the pressure of pilot hydraulic fluid (hydraulic fluid). Note, however, that this does not imply any limitation. For example, control valves to control the hydraulic actuators 51, 52, and 411*c* (first hydraulic cylinder(s) 51, second hydraulic cylinder(s) 52, and hydraulic cylinder(s) 411*c* of the work attachment(s) 41*c* and/or the like) may be solenoid valves (electromagnetic control valves) actuated in response to an electrical signal (electric current).

In the example embodiments described above, the working device 4 includes the arm(s) 40 connected to the machine body 2 and the work attachment 41*a* directly or indirectly connected to the arm(s) 40, and the work attachment 41*a* or the like is attached to the machine body 2 via the arm(s) 40. Note, however, that this does not imply any limitation. For example, the work attachment 41*a* or the like may be directly attached to the machine body 2. Note, however, that in such a case, the machine body 2 includes mechanism(s), part(s) (such as bracket(s)), and/or the like to attach the work attachment 41*a*.

In the example embodiments described above, a mechanical (analog) manual operator including the first operation lever 110 is used as the first manual operator 11 to be operated in relation to the travel of the machine body 2 (traveling devices 3). Accordingly, the first hydraulic circuit 5A includes the plurality of pump control valves 57 operably connected to the first operation lever 110 to control the flow of pilot hydraulic fluid to adjust the flow rate (delivery flow rate) of the second hydraulic pumps 56. Note, however, that this does not imply any limitation. For example, an electronic (digital) manual operator may be used as the first manual operator 11, and the controller 13 may be configured or programmed to adjust the delivery flow rate of the second hydraulic pumps (variable displacement hydraulic pumps) 56 based on the operation of the electronic (digital) manual operator.

Figure 14:
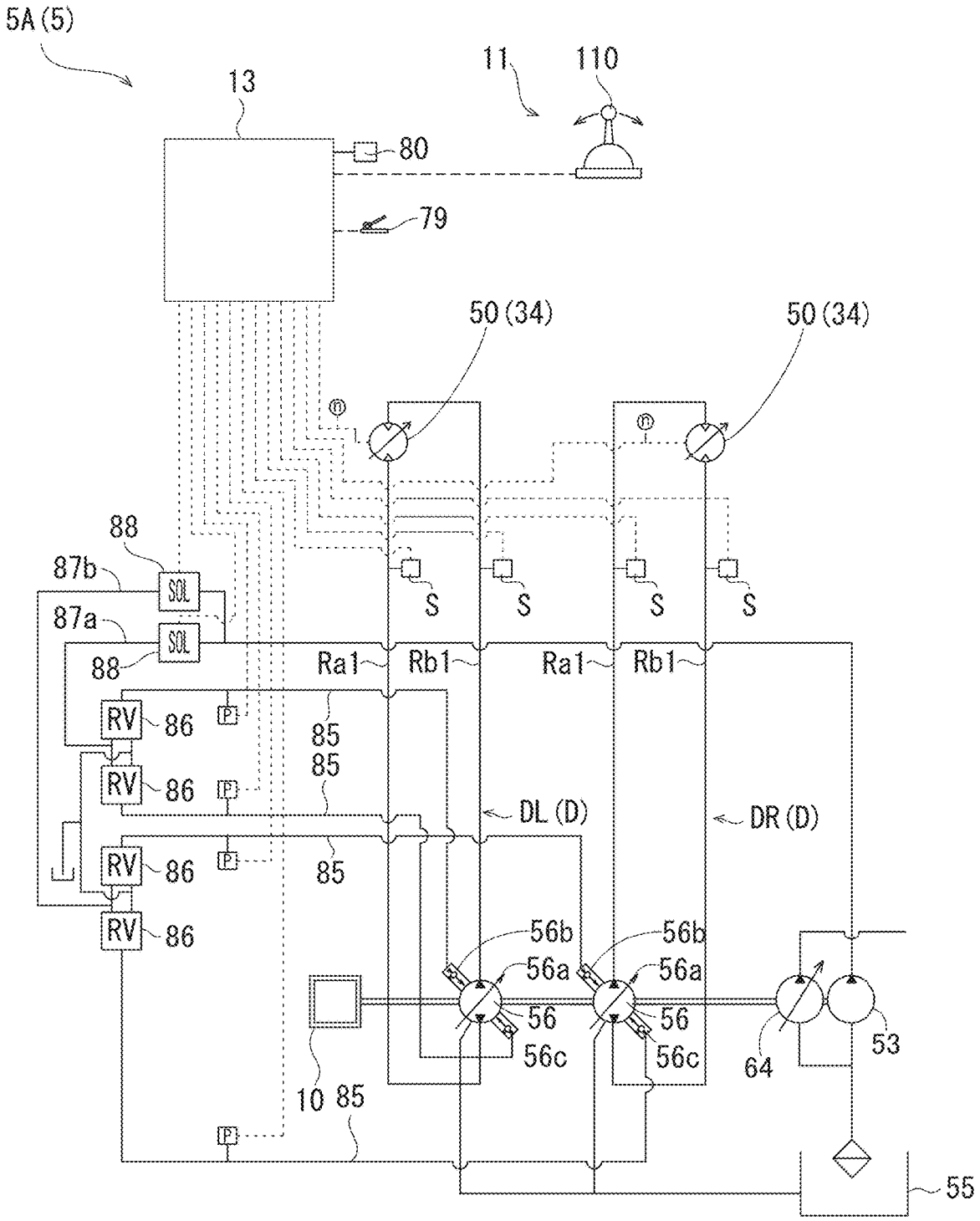
FIG. 14 schematically illustrates a first hydraulic circuit of a hydraulic circuit of a working machine according to another example embodiment of the present invention.

The following specifically discusses a configuration of the first manual operator 11 and the first hydraulic circuit 5A in such a case. As illustrated in FIG. 14, the first manual operator 11 is an electronic (digital) manual operator (such as a joystick) electrically connected to the controller 13 in a wireless or wired manner. That is, the first manual operator 11 is capable of wirelessly communicating with the controller 13, and therefore can be provided inside the cabin of the working machine 1, outside the cabin, or at a position away from the working machine 1, and is capable of remotely controlling the controller 13. The traveling motors 34 (50) and the second hydraulic pumps 56 of the first hydraulic circuit 5A are the same as those of the example embodiments described above. That is, each traveling motor 34 (50) is a variable displacement hydraulic motor, and the second hydraulic pump 56 to supply hydraulic fluid to the traveling motor 34 (50) is a variable displacement pump including a movable swash plate 56*a*, and a pair of pressure receivers 56*b* and 56*c* to change the angle and direction of tilt of the movable swash plate 56*a* and driven by the prime mover 10 (driven by power from the prime mover 10). Accordingly, the pressure detection sensors S to detect (measure) the pressure of hydraulic fluid supplied from the second hydraulic pumps 56 to the traveling motors 34 (50) are provided in the pairs of fluid passages R1*a* and R1*b* connecting the second hydraulic pumps 56 and the traveling motors 34 (50). The pressure detection sensors S are electrically connected to the controller 13 and output the value of the detected pressure of hydraulic fluid as an electrical signal to the controller 13 upon each detection. That is, the pressure detection sensors S detect the pressure of hydraulic fluid as the traveling loads on the traveling motors 34 (50) and output it to the controller 13, similarly to the example embodiments described above.

The first hydraulic circuit 5A also includes the first hydraulic pump 53 to deliver pilot hydraulic fluid, a plurality of (four) pilot lines (pilot fluid passages) 85 connected to the pairs of pressure receivers 56*b* and 56*c* of the pair of second hydraulic pumps 56 (the second hydraulic pump 56 for the first driver DR and the second hydraulic pump 56 for the second driver DL) to supply pilot hydraulic fluid from the first hydraulic pump 53 to the pressure receivers 56*b* and 56*c* of the second hydraulic pumps 56, and a plurality of (four) remote control valves 86 provided for the respective plurality of (four) pilot lines 85 and the like, electrically connected to the controller 13, and operable to adjust the pressure of pilot hydraulic fluid flowing through the plurality of pilot lines 85 and the like based on an instruction from the controller 13. Thus, the plurality of remote control valves 86 adjust the pressure of pilot hydraulic fluid in the pilot lines 85 based on an instruction from the controller 13. Therefore, the pair of second hydraulic pumps 56 supply hydraulic fluid at a delivery flow rate corresponding to the instruction from the controller 13 to the traveling motors 34 (50). Therefore, the pair of traveling motors 34 (50) may be brought into the drive state corresponding to the operation of the first manual operator 11 or the drive state based on the instruction from the controller 13 regardless of the operation of the first manual operator 11. This makes it possible to achieve the same control as the example embodiments described above.

In the first hydraulic circuit 5A, as illustrated in FIG. 14, a pilot line 87 connected to the first hydraulic pump 53 may branch into two pilot lines 87*a* and 87*b* at an intermediate position, the pilot line 87*a* may be connected to two remote control valves 86 corresponding to two pilot lines 85 connected to one of the second hydraulic pumps 56 (second hydraulic pump 56 for the first driver DR), and the pilot line 87*b* may be connected to two remote control valves 86 corresponding to two pilot lines 85 connected to the other second hydraulic pump 56 (second hydraulic pump 56 for the second driver DL).

In such a case, the branched two pilot lines 87*a* and 87*b* may be provided with pressure adjustment solenoid valves 88 to adjust the pressure of pilot hydraulic fluid flowing through the pilot lines 87*a* and 87*b* in accordance with an instruction from the controller 13 to a set pressure. With this, it is possible to set the value of the pressure of pilot hydraulic fluid in the two pilot lines 87*a* and 87*b* to a value between the maximum delivery pressure and minimum delivery pressure of the first hydraulic pump 53 based on an instruction from the controller 13, and therefore possible to change the pressure adjustment range achieved by the remote control valves 86 located downstream. This makes it possible to drive the pair of second hydraulic pumps 56 independently of each other, and change the delivery flow rate of hydraulic fluid of each pump depending on the travel state of the working machine 1 (traveling devices 3).

Figure 15:
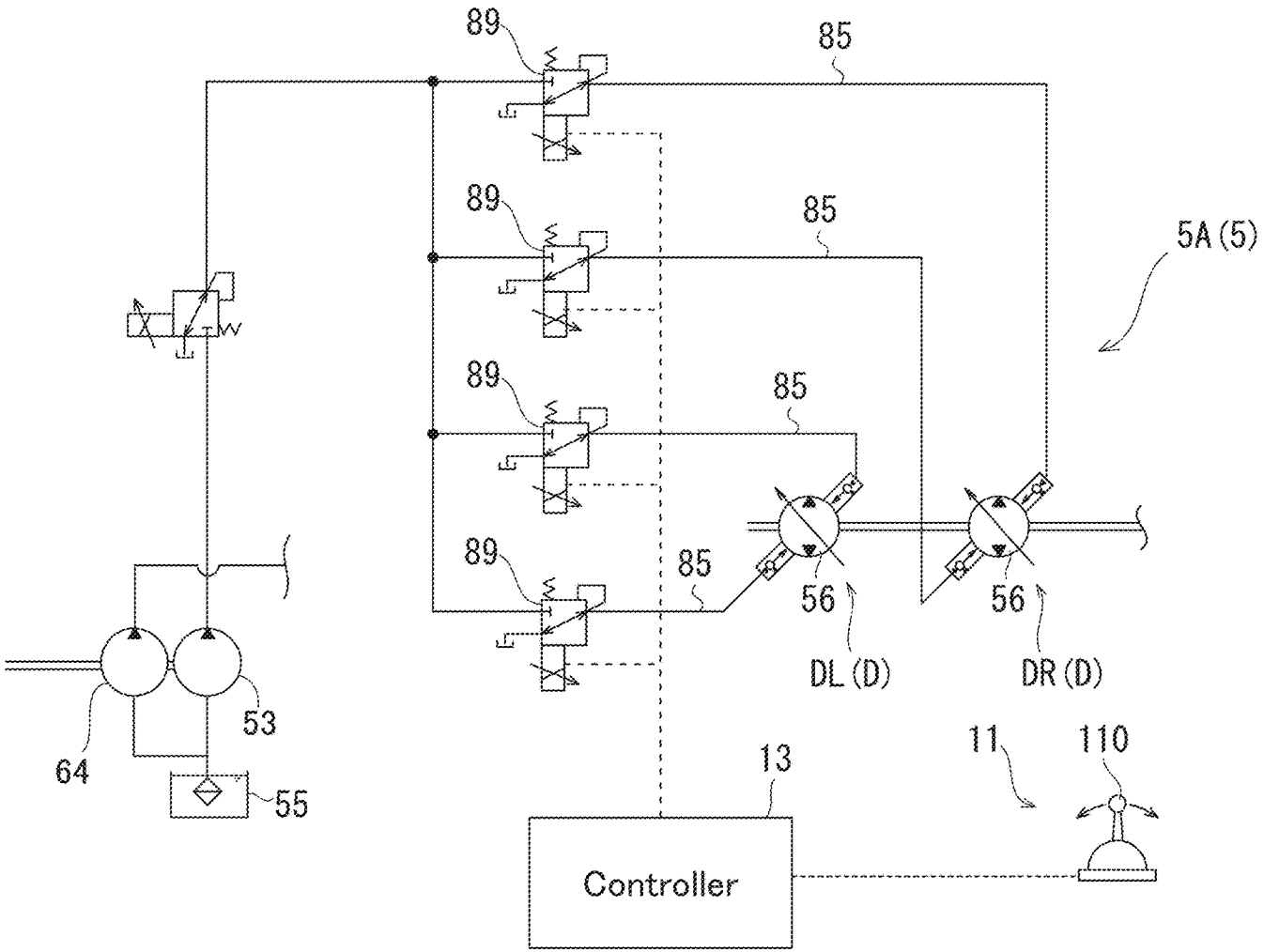
FIG. 15 schematically illustrates a first hydraulic circuit of a hydraulic circuit of a working machine according to another example embodiment of the present invention.

The first hydraulic circuit 5A illustrated in FIG. 14 may be replaced with a first hydraulic circuit 5A including the circuit structure as illustrated in FIG. 15. Note that, in FIG. 15, the traveling motors 50 (34) are not illustrated, but the manner in which the traveling motors 50 (34) and the second hydraulic pumps 56 are connected is the same as the first hydraulic circuit 5A as illustrated in FIG. 14. Therefore, also in the first hydraulic circuit 5A including the circuit structure as illustrated in FIG. 15, the pressure detection sensors S to detect (measure) the pressure of hydraulic fluid supplied from the second hydraulic pumps 56 to the traveling motors 34 (50) are provided in the pairs of fluid passages R1*a* and R1*b* connecting the second hydraulic pumps 56 and the traveling motors 34 (50), and the rotation sensors 35L and 35R to measure the rotational speeds of the traveling motors 50 (34) are provided, making it possible to evaluate the state of the machine body 2 in the same manner as the example embodiments described above.

Specifically, the first hydraulic circuit 5A may include the first hydraulic pump 53 to deliver pilot hydraulic fluid, a plurality of (four) pilot lines (pilot fluid passages) 85 connected to the pairs of pressure receivers 56*b* and 56*c* of the pair of second hydraulic pumps 56 (the second hydraulic pump 56 for the first driver DR and the second hydraulic pump 56 for the second driver DL) to supply pilot hydraulic fluid from the first hydraulic pump 53 to the pressure receivers 56*b* and 56*c* of the second hydraulic pumps 56, and a plurality of (four) proportional electromagnetic valves 89 provided in the respective plurality of (four) pilot lines 85, electrically connected to the controller 13, and operable to adjust the pressure of pilot hydraulic fluid flowing through the plurality of pilot lines 85 based on an instruction from the controller 13. With this, the proportional electromagnetic valves 89 are electrically controlled by the controller 13, so that the flow of hydraulic fluid (pilot hydraulic fluid) in the pilot lines 85 is controlled with high accuracy, and therefore the pair of second hydraulic pumps 56 (the second hydraulic pump 56 for the first driver DR and the second hydraulic pump 56 for the second driver DL) are appropriately driven depending on the situation. Also in such a case, the first manual operator 11 is an electronic (digital) manual operator (such as a joystick) electrically connected to the controller 13 in a wired or wireless manner. That is, the first manual operator 11 is capable of wirelessly communicating with the controller 13, and therefore can be provided not only inside the cabin of the working machine 1 but also outside the cabin or at a position away from the working machine 1 and remotely control the controller 13.

In the example embodiments described above, the icon of the work attachment 41*a* or the like used by the user is selected from the attachment list displayed on the display 14, and the controller 13 retrieves (extracts) the reference load P1, P2 for the work attachment 41*a* or the like corresponding to the selected icon from the storing unit 131. Note, however, that this does not imply any limitation. For example, the controller 13 may automatically recognize the attachment (work attachment) 41*a* or the like which is connected to the arm(s) 40 and may retrieve (extract) the reference load P2, P2 for the recognized work attachment 41*a* or the like from the storing unit 131. In such a case, for example, the controller 13 need only recognize the work attachment 41*a* or the like based on an attachment ID (identification information relating to the attachment 41*a* or the like) contained in a wireless signal (advertisement signal) transmitted from a beacon transmitter attached to the work attachment 41*a* or the like.

Figure 16:
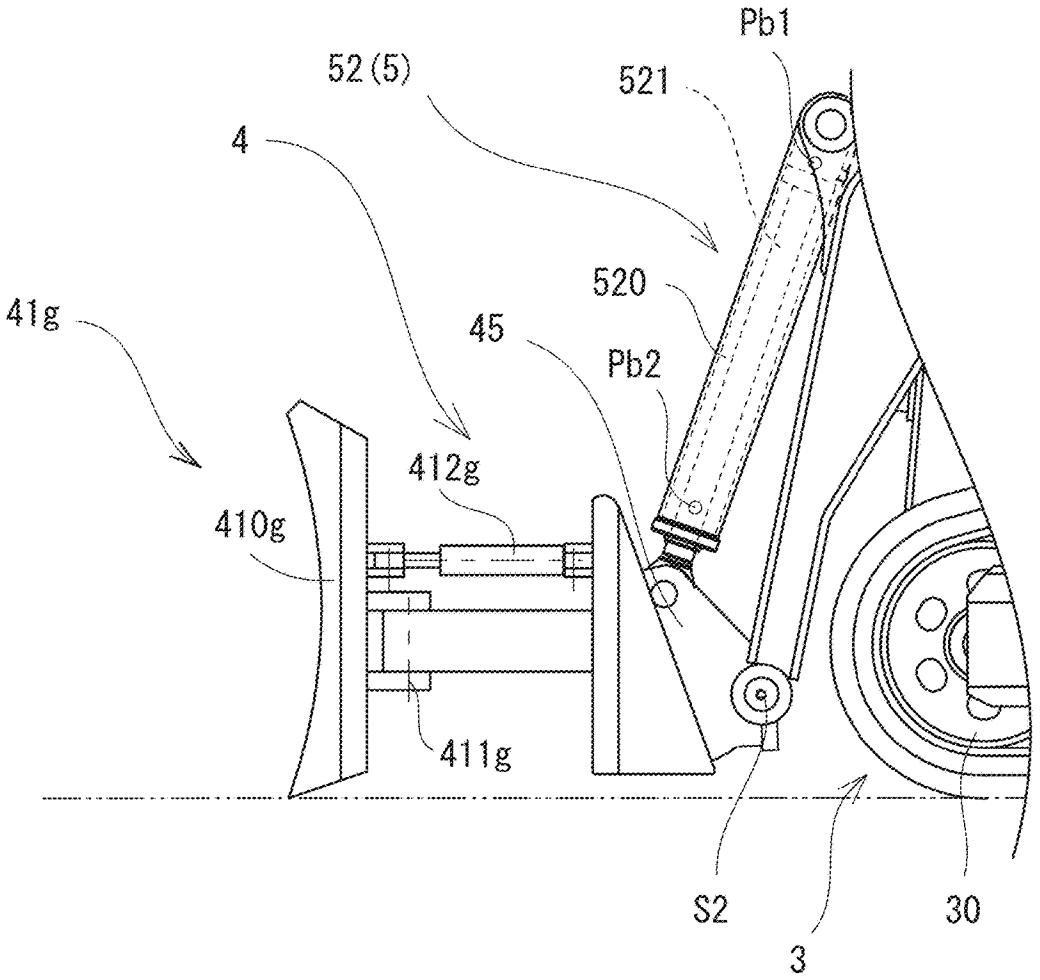
FIG. 16 is a partial side view of a variation of a work attachment of a working machine according to another example embodiment of the present invention.
Figure 17:
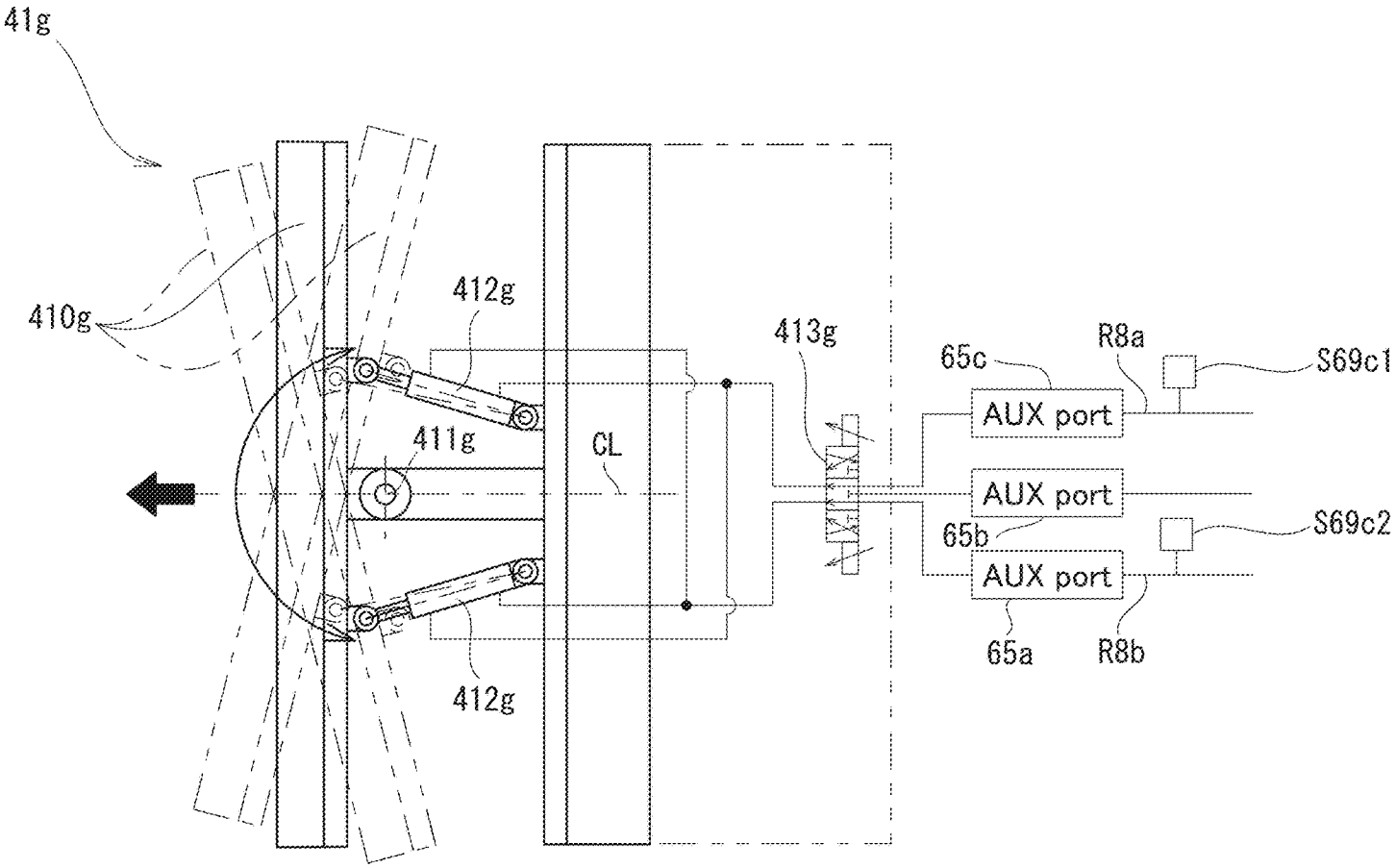
FIG. 17 is a plan view schematically illustrating the work attachment illustrated in FIG. 16 including a portion of a hydraulic system.

In the example embodiments described, it is determined that the state of the machine body 2 differs from the instruction provided by the operation of the manual operator (first manual operator) 11 when the traveling loads on the pair of traveling devices 3 differ from each other. Note, however, that this does not imply any limitation. For example, as illustrated in FIGS. 16 and 17, the controller 13 may be configured or programmed to, in a case that the work attachment 41*g* includes a pair of actuators 412*g* which are arranged at an interval in a direction (width direction of the machine body 2) perpendicular to a direction of straight travel (forward travel) of the pair of traveling devices 3 and perpendicular to an up-and-down direction and which are operable to independently exert driving forces in a direction of forward travel of the pair of traveling devices 3, if loads on the pair of actuators 412*g* during the travel of the machine body 2 differ from each other, determine that the state of the machine body 2 differs from the instruction provided by the operation of the first manual operator 11.

Specifically, examples of a work attachment 41*g* include a dozer including a blade 410*g* in which the blade 410*g* is rotatable about an axis (shaft 411*g*) extending in the up-down direction and perpendicular to a centerline CL extending in the front-rear direction through the widthwise center of the machine body 2 and which includes hydraulic cylinders 412*g* as a pair of actuators to rotate the blade 410*g* about the axis (shaft 411*g*).

In the work attachment 41*g*, the pair of actuators 412*g* are symmetrical with respect to the centerline CL of the machine body 2 such that they are extendable and retractable in the front-rear direction. That is, the pair of actuators 412*g* are arranged with the rotation center (shaft 411*g*) of the blade 410*g* therebetween to support the blade 410*g* at the opposite sides of the widthwise center of the blade 410*g*. The pair of actuators 412*g*, when fluid passages (route for supply/discharge of hydraulic fluid) are switched (changed) by a solenoid valve 413*g* of the work attachment 41*g*, each bias the blade 410*g* as needed to change the direction of the blade 410*g*. That is, when one of the actuators 412*g* extends, the other actuator 412*g* retracts, so that the direction of the blade 410*g* changes.

In the case of such a work attachment 41*g*, the pair of actuators 412*g* (hydraulic cylinders) are connected to the AUX ports 65*a*, 65*b*, and 65*c*, and extend and retract in response to the supply and discharge of hydraulic fluid. When the blade 410*g* pushes earth and sand or soil etc., the force acting of the blade 410*g* also acts on the pair of actuators 412*g*. When both the pair of actuators 412*g* are extended and support the blade 410*g*, if equal loads (weights) are acting on the opposite sides of the widthwise center of the blade 410*g*, the traveling loads on the pair of traveling devices 3 are also equal, so that, in the case where the first manual operator 11 is operated to indicate straight travel, the straight travel can be achieved as indicated by the operation of the first manual operator 11.

On the contrary, when both the pair of actuators 412*g* are extended and support the blade 410*g*, if the load (weight) acting on one of the opposite sides of the widthwise center of the blade 410*g* is greater than the load (weight) on the other of the opposite sides of the widthwise center (loading is eccentric in the width direction), the traveling load on one of the pair of traveling devices 3 increases. That is, when the load (weight) on one of the opposite sides of the widthwise center of the blade 410*g* is greater than the other, the traveling load on one of the traveling devices 3 arranged in the width direction of the machine body 2 is greater than the traveling load on the other traveling device 3, so that the machine body 2 cannot travel straight even when the first manual operator 11 is operated to indicate straight travel. If the load acting on the blade 410*g* is an eccentric load, the balance between the loads on the pair of actuators 412*g* is lost as the loads increase or decrease, so that the load on one of the actuators 412*g* is greater than the load on the other actuator 412*g*. Therefore, in the case where the pair of actuators 412*g* are hydraulic cylinders, the pressure of hydraulic fluid in the fluid passages connected to the pair of actuators 412*g* also changes.

Accordingly, using the detection results from the third pressure detectors 69*c*1 and 69*c*2 to detect the pressure of hydraulic fluid in the hydraulic actuators 412*g* of the work attachment 41*g* (third pressure detectors 69*c*1 and 69*c*2 to detect the pressure in third supply-discharge passages (fluid passages) R8*a* and R8*b* connected to the AUX ports 65*a*, 65*b*, and 65*c*), it is possible to determine (estimate) the state of the loads on the blade 410*g* or the state of the machine body 2 (whether the machine body 2 is traveling straight or making meandering motions).

Figure 18:
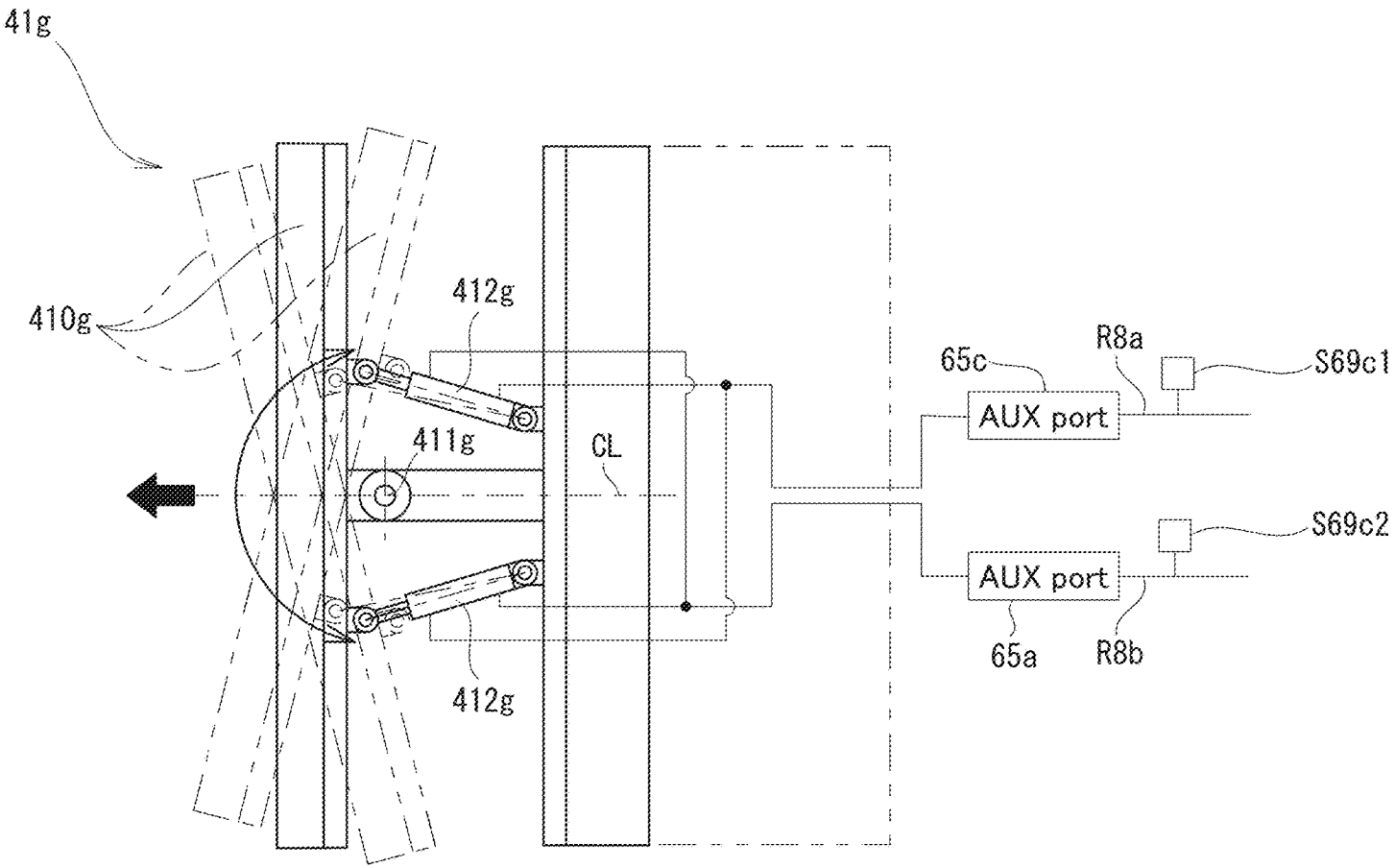
FIG. 18 is a plan view schematically illustrating another work attachment according to another example embodiment of the present invention including a portion of a hydraulic system.

Therefore, in the case where the loads (pressure of hydraulic fluid) on the pair of actuators 412*g* differ from each other, by driving the pair of traveling devices 3 differently, it is possible to achieve the travel as indicated by the operation of the manual operator, similarly to the example embodiments described earlier. Note that, also in the case where the work attachment 41*g* includes the pair of actuators 412*g*, the controller may be configured or programmed to, if the traveling loads on the pair of traveling devices 3 differ from each other during travel of the machine body 2, determine that the state of the machine body 2 differs from the instruction provided by the operation of the first manual operator 11, similarly to the example embodiments described earlier. With regard to the determination of whether the state of the machine body 2 differs from the instruction provided by the operation of the first manual operator 11, the controller may be configured or programmed to, if a work attachment 41*a* or the like to be attached to the machine body 2 can be selected from a plurality of work attachments 41*a* and the like and a work attachment 41*g* including actuators 412*g* is selected, evaluate the state of the machine body 2 based on the difference between the loads on the actuators 412*g*. Note that, with regard to the work attachment 41*g* illustrated in FIG. 17, the pair of actuators 412*g* are extended and retracted by switching the fluid passages using the solenoid valve 413*g* included in the work attachment 41*g*. In this regard, for example, in the case where the work attachment 41*g* includes no solenoid valves as illustrated in FIG. 18, the pair of actuators 412*g* may be connected to the AUX ports 65*a* and 65*c* without using solenoid valves. In such a case, by switching the fluid passages (routes for supply/discharge of hydraulic fluid) using the third control valve 68 of the second hydraulic circuit 5B, it is possible to cause the pair of actuators 412*g* to extend and/or retract to change the direction of the blade 410*g*. Similarly to the cases where the work attachment 41*g* as illustrated in FIG. 17 is attached, it is also possible to determine (estimate) the state of the machine body 2 based on the difference between the loads on the pair of attachments 412*g* (the detection results from the third pressure detectors 69*c*1 and 69*c*2 (the third pressure detectors 69*c*1 and 69*c*2 to detect the pressure in the third supply-discharge passages (fluid passages) R8*a* and R8*b* connected to the AUX ports 65*a*, 65*b*, and 65*c*).

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body to attach a work attachment thereto;

a pair of traveling devices to support opposite side portions of the machine body such that the machine body is allowed to travel, the pair of traveling devices being operable to be driven independently of each other;

a manual operator to be operated by a user in relation to travel of the machine body; and a controller configured or programmed to perform control relating to the travel of the machine body; wherein the controller is configured or programmed to, while the manual operator is operated in relation to the travel of the machine body, drive the pair of traveling devices independently of each other based on at least one of a state of the machine body or a state of the pair of traveling devices to bring a travel state of the machine body into agreement with an instruction provided by operation of the manual operator; and the controller is configured or programmed to, while the manual operator is operated to cause the machine body to travel straight, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

2. The working machine according to claim 1, wherein the controller is configured or programmed to, while the manual operator is operated to cause the machine body to travel straight, if traveling loads on the pair of traveling devices differ from each other during the travel of the machine body, determine that the state of the machine body differs from the instruction provided by the operation of the manual operator.

3. The working machine according to claim 2, wherein the controller is configured or programmed to, if the state of the machine body differs from the instruction provided by the operation of the manual operator while the manual operator is operated to cause the machine body to travel straight, drive a first one of the pair of traveling devices that is subjected to a greater traveling load at a drive rotational speed higher than a drive rotational speed of a second one of the pair of traveling devices that is subjected to a smaller traveling load to bring the travel state of the machine body into agreement with the instruction provided by the operation of the manual operator.

4. The working machine according to claim 3, wherein the controller is configured or programmed to determine whether the traveling loads on the pair of traveling devices differ from each other by comparing a preset reference load and the traveling load on at least one of the pair of traveling devices during the travel of the machine body.

5. The working machine according to claim 3, wherein the controller is configured or programmed to:

enter a low-speed mode in which the controller causes the machine body to travel at a reference speed lower than a predetermined reference speed; and when in the low-speed mode, drive one of the pair of traveling devices that is subjected to the greater load at a drive rotational speed higher than a drive rotational speed corresponding to a travel speed corresponding to the operation of the manual operator and than a drive rotational speed corresponding to a travel speed of the machine body in the low-speed mode.

6. The working machine according to claim 4, wherein the machine body includes a structure to allow attachment thereto and detachment therefrom a work attachment to perform specific work such that the work attachment is replaceable with any of a plurality of types of work attachments to perform different types of work differing from the specific work; and the controller is configured or programmed to:

extract a reference load for the work attachment attached to the machine body from a plurality of preset reference loads for a plurality of types of work attachments; and determine whether the traveling loads on the pair of traveling devices differ from each other by comparing the extracted reference load and the traveling load on at least one of the pair of traveling devices during the travel of the machine body.

7. The working machine according to claim 6, wherein the controller is configured or programmed to recognize a type of the work attachment attached to the machine body; and the plurality of preset reference loads are set based on respective work characteristics and/or respective work conditions of the plurality of types of work attachments.

8. The working machine according to claim 7, wherein the pair of traveling devices include respective drive motors; and the controller is configured or programmed to recognize loads on the drive motors of the pair of traveling devices during the travel of the machine body as the traveling loads on the pair of traveling devices.

9. The working machine according to claim 8, wherein the drive motors include hydraulic motors;

the reference loads are values of hydraulic pressure; and the loads on the drive motors are values of a pressure of hydraulic fluid supplied to the hydraulic motors.

10. The working machine according to claim 9, further comprising:

a hydraulic pump to supply hydraulic fluid to the hydraulic motors; wherein the values of the pressure of hydraulic fluid are values of a pressure of hydraulic fluid supplied from the hydraulic pump to the hydraulic motors.

11. The working machine according to claim 1, wherein the controller is configured or programmed to, in a case that the machine body has attached thereto the work attachment including a pair of actuators which are arranged at an interval in a direction perpendicular to a direction of straight travel of the pair of traveling devices and perpendicular to an up-and-down direction and which are operable to independently exert driving forces in a direction of forward travel of the pair of traveling devices, if the manual operator is operated to cause the machine body to travel straight and loads on the pair of actuators during the travel of the machine body differ from each other, determine that the state of the machine body differs from the instruction provided by the operation of the manual operator.

12. The working machine according to claim 11, wherein the controller is configured or programmed to, if the state of the machine body differs from the instruction provided by the operation of the manual operator while the manual operator is operated to cause the machine body to travel straight, drive a first one of the pair of traveling devices that is subjected to a greater traveling load at a drive rotational speed higher than a drive rotational speed of a second one of the pair of traveling devices that is subjected to a smaller traveling load to bring the travel state of the machine body into agreement with the instruction provided by the operation of the manual operator.

13. A working machine comprising:

a machine body to attach a work attachment thereto;

a pair of traveling devices to support opposite side portions of the machine body such that the machine body is allowed to travel, the pair of traveling devices being operable to be driven independently of each other;

a manual operator to be operated by a user in relation to travel of the machine body; and a controller configured or programmed to perform control relating to the travel of the machine body; wherein the controller is configured or programmed to, while the manual operator is operated in relation to the travel of the machine body, drive the pair of traveling devices independently of each other based on at least one of a state of the machine body or a state of the pair of traveling devices to bring a travel state of the machine body into agreement with an instruction provided by operation of the manual operator; and the controller is configured or programmed to, in a case that the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

14. The working machine according to claim 13, wherein the controller is configured or programmed to, if a traveling load on a first one of the pair of traveling devices is equal to or more than a predetermined value, a drive rotational speed of the first one of the pair of traveling devices is less than a predetermined rotational speed, a traveling load on a second one of the pair of traveling devices is less than the predetermined value, and a drive rotational speed of the second one of the pair of traveling devices is equal to or higher than the predetermined rotational speed, set the drive rotational speed of the second one of the pair of traveling devices to a drive rotational speed lower than the drive rotational speed of the first one of the pair of traveling devices.

15. The working machine according to claim 14, wherein the controller is configured or programmed to, while the manual operator is operated to cause the pair of traveling devices to travel straight forward, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

16. The working machine according to claim 13, wherein the controller is configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, drive the first one of the pair of traveling devices at a drive rotational speed corresponding to the operation of the manual operator and drive the second one of the pair of traveling devices at a drive rotational speed lower than the drive rotational speed corresponding to the operation of the manual operator.

17. The working machine according to claim 16, wherein the controller is configured or programmed to, while the manual operator is operated to cause the pair of traveling devices to travel straight forward, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

18. The working machine according to claim 13, wherein the controller is configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, drive each of the pair of traveling devices at a drive rotational speed lower than a drive rotational speed corresponding to the operation of the manual operator.

19. The working machine according to claim 18, wherein the controller is configured or programmed to, while the manual operator is operated to cause the pair of traveling devices to travel straight forward, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

20. The working machine according to claim 13, further comprising:

a pair of hydraulic motors to drive the respective pair of traveling devices; and a pair of hydraulic pumps to supply hydraulic fluid to the respective pair of hydraulic motors; wherein the controller is configured or programmed to, if a traveling load on a first one of the pair of traveling devices is equal to or more than a predetermined value, a drive rotational speed of the first one of the pair of traveling devices is less than a predetermined rotational speed, a traveling load on the second one of the pair of traveling devices is less than the predetermined value, and a drive rotational speed of the second one of the pair of traveling devices is equal to or higher than the predetermined rotational speed, perform control such that a delivery flow rate of hydraulic fluid from a second one of the pair of hydraulic pumps to supply the hydraulic fluid to a second one of the pair of hydraulic motors to drive the second one of the pair of traveling devices is less than a delivery flow rate of hydraulic fluid from a first one of the pair of hydraulic pumps to supply the hydraulic fluid to a first one of the pair of hydraulic motors to drive the first one of the pair of traveling devices.

21. The working machine according to claim 20, wherein the traveling loads on the pair of traveling devices include values of a pressure of hydraulic fluid supplied to the pair of hydraulic motors; and the values of the pressure of hydraulic fluid include values of a pressure of hydraulic fluid supplied from the pair of hydraulic pumps to the pair of hydraulic motors.

22. The working machine according to claim 20, wherein the controller is configured or programmed to, while the manual operator is operated to cause the pair of traveling devices to travel straight forward, if the state of the machine body differs from the instruction provided by the operation of the manual operator, drive the pair of traveling devices such that outputs of the pair of traveling devices differ from each other to bring the travel state of the machine body into agreement with the instruction provided by the operation of the manual operator.

* * * * *